US005220394A

United States Patent [19]

Kato et al.

[11] Patent Number: 5,220,394

[45] Date of Patent: Jun. 15, 1993

[54] COPYING APPARATUS HAVING CONTROLLER FOR PRODUCING BOOK-TYPE COPIES

[75] Inventors: Tomokazu Kato, Toyokawa; Masazumi Ito, Toyohashi; Kazuhiro Araki, Okazaki; Yoichi Kawabuchi; Toshiyuki Yamashita, both of Toyokawa, all of Japan

[73] Assignee: Minolta Camera Kabushiki Kaisha, Osaka, Japan

[21] Appl. No.: 709,582

[22] Filed: Jun. 3, 1991

[30] Foreign Application Priority Data

Jun. 5, 1990 [JP] Japan ..... 2-146796

[51] Int. Cl.[5] ..... G03G 15/00

[52] U.S. Cl. ..... 355/309; 355/25; 355/311

[58] Field of Search ..... 355/25, 311, 325, 23, 355/24, 313, 319, 320

[56] References Cited

U.S. PATENT DOCUMENTS

| | | | |
|---|---|---|---|
| 4,218,130 | 8/1980 | Satomi et al. | 355/25 X |
| 4,334,765 | 6/1982 | Clark | 355/25 X |
| 4,592,651 | 6/1986 | Oikawa et al. | 355/319 X |
| 4,727,402 | 2/1988 | Smith | 355/319 |
| 4,763,161 | 8/1988 | Forest et al. | 355/207 |
| 4,855,790 | 8/1989 | Suzuki | 355/24 |
| 4,924,265 | 5/1990 | Partilla et al. | 355/325 X |
| 5,079,598 | 1/1992 | Kaneko et al. | 355/313 X |

FOREIGN PATENT DOCUMENTS

| | | |
|---|---|---|
| 0040564 | 3/1983 | Japan . |
| 0197335 | 9/1986 | Japan . |

OTHER PUBLICATIONS

"The Xerox 1050 Operator Manual," pp. 35–38 and 50.
"The Xerox 5052 Operator Manual," pp. 36–41.

*Primary Examiner*—A. T. Grimley
*Assistant Examiner*—Robert Beatty
*Attorney, Agent, or Firm*—Willian Brinks Olds Hofer Gilson & Lione

[57] ABSTRACT

A copying apparatus copies an image of each original document either in a one-side copy mode or a both-side copy mode during a cover copy mode. The copying apparatus is capable of selectively supplying colored copy sheets for a cover page and ordinary white copy sheets for the other pages. A controller controls the copying apparatus such that the image of one cover page is copied on one side of a colored copy sheet, the image of each table of contents is copied on one side of a white copy sheet, and the image of each of the other content pages is copied on both sides of a white copy sheet.

22 Claims, 16 Drawing Sheets

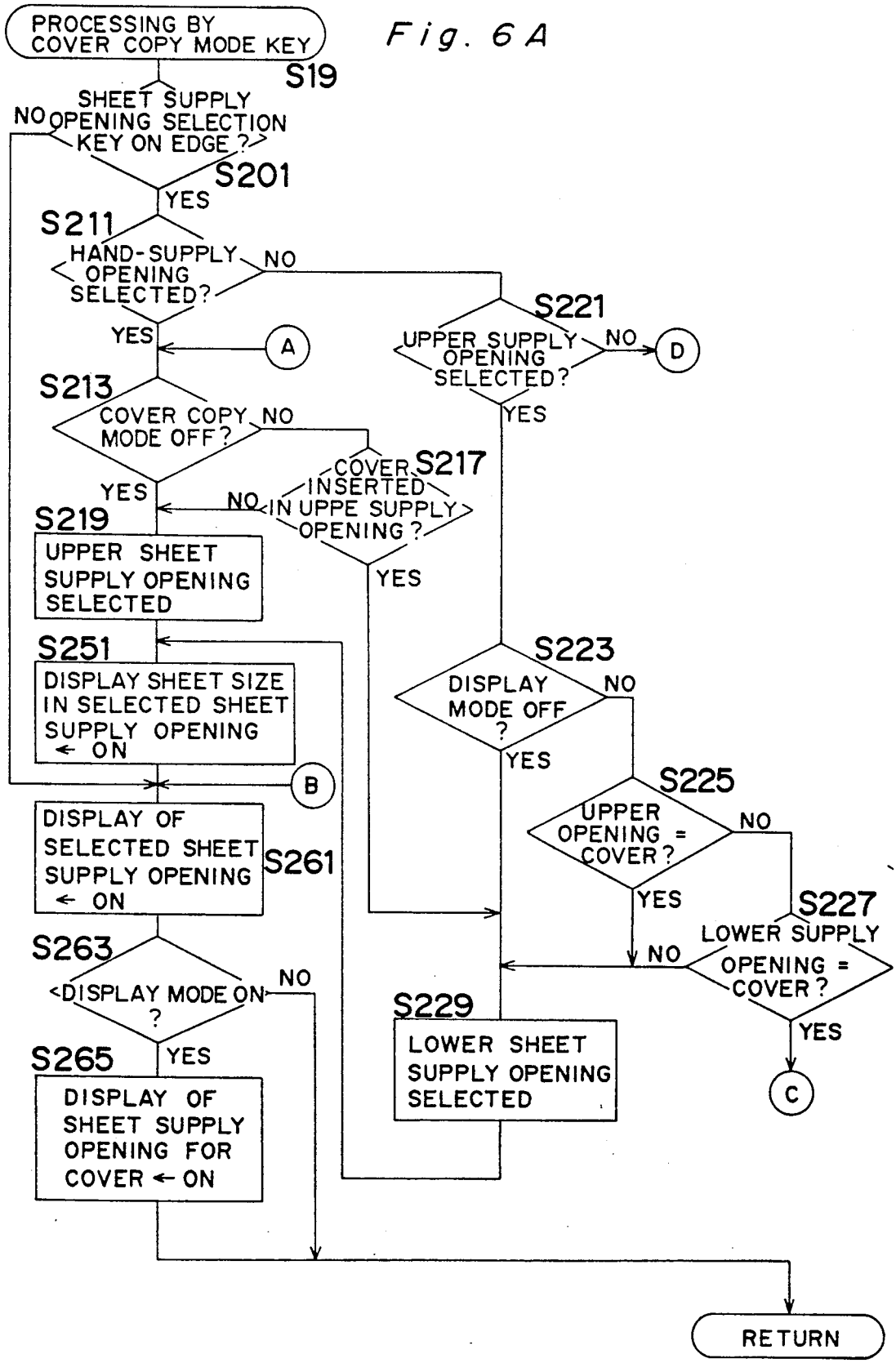
Fig. 6A
PROCESSING BY COVER COPY MODE KEY
S19
SHEET SUPPLY OPENING SELECTION KEY ON EDGE ?
S201
NO
YES
S211
HAND-SUPPLY OPENING SELECTED?
NO
YES
A
S221
UPPER SUPPLY OPENING SELECTED?
NO
D
YES
S213
COVER COPY MODE OFF ?
NO
YES
COVER INSERTED IN UPPE SUPPLY OPENING ?
S217
NO
YES
S219
UPPER SHEET SUPPLY OPENING SELECTED
S251
DISPLAY SHEET SIZE IN SELECTED SHEET SUPPLY OPENING ← ON
B
DISPLAY OF SELECTED SHEET SUPPLY OPENING ← ON
S261
S263
DISPLAY MODE ON ?
NO
YES
S265
DISPLAY OF SHEET SUPPLY OPENING FOR COVER ← ON
S223
DISPLAY MODE OFF ?
NO
YES
S225
UPPER OPENING = COVER ?
NO
YES
S227
LOWER SUPPLY OPENING = COVER ?
NO
YES
C
S229
LOWER SHEET SUPPLY OPENING SELECTED
RETURN

COPYING APPARATUS HAVING CONTROLLER FOR PRODUCING BOOK-TYPE COPIES

BACKGROUND OF THE INVENTION

1. Field of the Invention

The present invention relates to a copying apparatus capable of performing a copying operation in a one-side copy mode in which an image is formed on one side of a copy sheet and in a both-side copy mode in which images are formed on both sides thereof and selecting a cover copy mode in which the kind of copy sheet for the cover page of a series of original documents is different from the kind of copy sheets for the other pages.

2. Description of the Related Art

Conventionally, the following type of copying apparatus has been proposed: a copying apparatus provided with a unit for forming the image of one original document on one side a copy sheet and the image of the other original document on the other side thereof, namely, the unit for accommodating the copy sheet having the image of one original document copied on one side thereof and re-supplying the image-formed copy sheet to an image forming section by inverting it so that the image of the other original document is copied on the other side thereof.

The following type of copying apparatus has been also proposed in which an original document feeder (ADF) detects the cover page of original documents from among a series of original documents sequentially fed to an original document scanning position so as to copy the image of the cover page on a copy sheet in a color different from the color of the copied image of pages other than the cover page. In addition, a copying apparatus which forms the image of the cover page on a copy sheet different in quality from copy sheets for other pages is proposed.

Meanwhile, there is a demand for copying the image of the cover page on a copy sheet different in color, size, or quality from copy sheets for other pages in forming copied images on both sides of each copy sheet by automatically feeding each original document to the original document scanning position.

There is also a demand for copying the image of the page of the table of contents on a copy sheet in such a manner that the image-copied sheet is distinguished from each copy sheet on which the image of each of other pages has been copied.

SUMMARY OF THE INVENTION

Accordingly, an essential object of the present invention is to provide a copying apparatus which satisfies the above-described demands. In accomplishing these and other objects, according to a preferred embodiment, there is provided a copying apparatus comprising: an original document tray on which a plurality of original documents are piled one on the other in order of page; original document feeding means for sequentially feeding each original document into a light-exposing section; image forming means, for forming an image of each original document fed into the light-exposing section on a copy sheet, operable in one-side copy mode and both-side copy mode; copy sheet supply means for accommodating a copy sheet of a first type of copy sheet and a copy sheet of a second type and feeding either the copy sheet of the first type or the copy sheet of the second type into the image forming means; and control means for controlling the image forming means and the copy sheet supply means so that the image of a first page of the original documents is formed on one side of a copy sheet of the first type, the image of a second page thereof is formed on one side of a copy sheet of the second type, and the image of a third page through the last page thereof is formed on both sides of each copy sheet of the second type.

In the above construction, let it be supposed that the image of each of a plurality of original documents including one cover, one table of contents and a plurality of content pages, which is a typical example of original documents, is copied. The image of the cover page is copied on one side of a copy sheet of the first type, the image of the page of table of contents is copied on one side of a copy sheet of the second type, the image of each of other content pages is copied on both sides of each copy sheet of the second type, resulting in a preferable edition of copied sheets.

According to one preferred embodiment, there is provided a copying apparatus comprising: an original document tray on which N sheets of original documents are piled one on the other in order of page; original document feeding means for sequentially feeding each original document into a light-exposing section in a page-reversed order; image forming means, for forming an image of each original document fed into the light-exposing section on a copy sheet, operable in one-side copy mode and both-side copy mode; copy mode selecting means for selecting either one-side copy mode or both-side copy mode; means for inputting the number N of original documents; first copy sheet supply means for feeding a plurality of copy sheets into the image forming means one by one; second copy sheet supply means for feeding a plurality of copy sheets different in type from those fed by the first copy sheet supply means into the image forming means one by one; cover copy mode selecting means for selecting cover copy mode; and control means for controlling the image forming means, the first copy sheet supply means, and the second copy sheet supply means so that when both-side copy mode and cover copy mode are selected, each image of a third page through the last page of the original documents is formed on both sides of each copy sheet supplied from the first copy sheet supply means, the image of a second page thereof is formed on one side of a copy sheet supplied from the first copy sheet supply means, and the image of a first page thereof is formed on one side of a copy sheet supplied from the second copy sheet supply means.

According to the above construction, supposing that the same typical example of original documents as described above, when both-side copy mode and cover copy mode are selected, the image of the cover page is copied on one side of a copy sheet supplied from the second copy sheet supply means, the image of the page of table of contents is copied on one side of a copy sheet supplied from the first copy sheet supply means, and each of other content pages is copied on both sides of each copy sheet supplied from the first copy sheet supply means.

According to still another preferred embodiment, there is provided a copying apparatus comprising: an original document tray on which a plurality of original documents are piled one on the other in order of page; original document feeding means for sequentially feeding each original document into a light-exposing section; image forming means, for forming the image of each original document fed into the light-exposing section on a copy sheet, operable in one-side copy mode and both-side copy mode; numerical value input means for inputting a natural number M ($0<M$); copy sheet supply means accommodating copy sheets of first and second type and selectively feeding either copy sheets of the first type or copy sheets of the second type into the image forming means; and control means for controlling the image forming means and the copy sheet supply means so that the image of a first page of the original documents is formed on one side of a copy sheet of the first type; each image of a second page through $(M+1)$th page thereof is formed on one side of each copy sheet of the second type; and each image of $(M+2)$th page through the last page thereof is formed on both sides of each copy sheet of the second type.

A series of original documents may include table of contents in two pages or more. According to the above construction, the image of each page of content of tables can be copied on one side of a copy sheet of the same type as the copy sheet for other pages except the cover page by inputting the number M of table of contents using the numerical value input means.

BRIEF DESCRIPTION OF THE DRAWINGS

These and other objects and features of the present invention will become apparent from the following description taken in conjunction with the preferred embodiments thereof with reference to the accompanying drawings, in which:

FIGS. 4 through 14 are flowcharts showing the processing to be performed by the control CPU of the copying apparatus; in which:

FIG. 4 shows a main routine;

FIG. 5 shows the subroutine of processing by a cover copy mode key;

FIGS. 6A and 6B show the subroutine of processing by a key for selecting copy sheet supply opening;

FIG. 7 shows the subroutine of processing by a copy mode key;

FIG. 8 shows the subroutine of processing for inputting the number of original documents;

FIG. 10 shows the subroutine of processing for switching copy sheet supply opening;

FIG. 11 shows the subroutine of processing for switching cover mode;

FIG. 12 shows the subroutine of processing for selecting a copy sheet supply opening for a cover;

FIG. 13 shows the subroutine of processing a copying operation; and FIG. 14 shows the subroutine of checking the existence of the copy sheet for the cover.

DETAILED DESCRIPTION OF THE EMBODIMENTS

Figure 1:
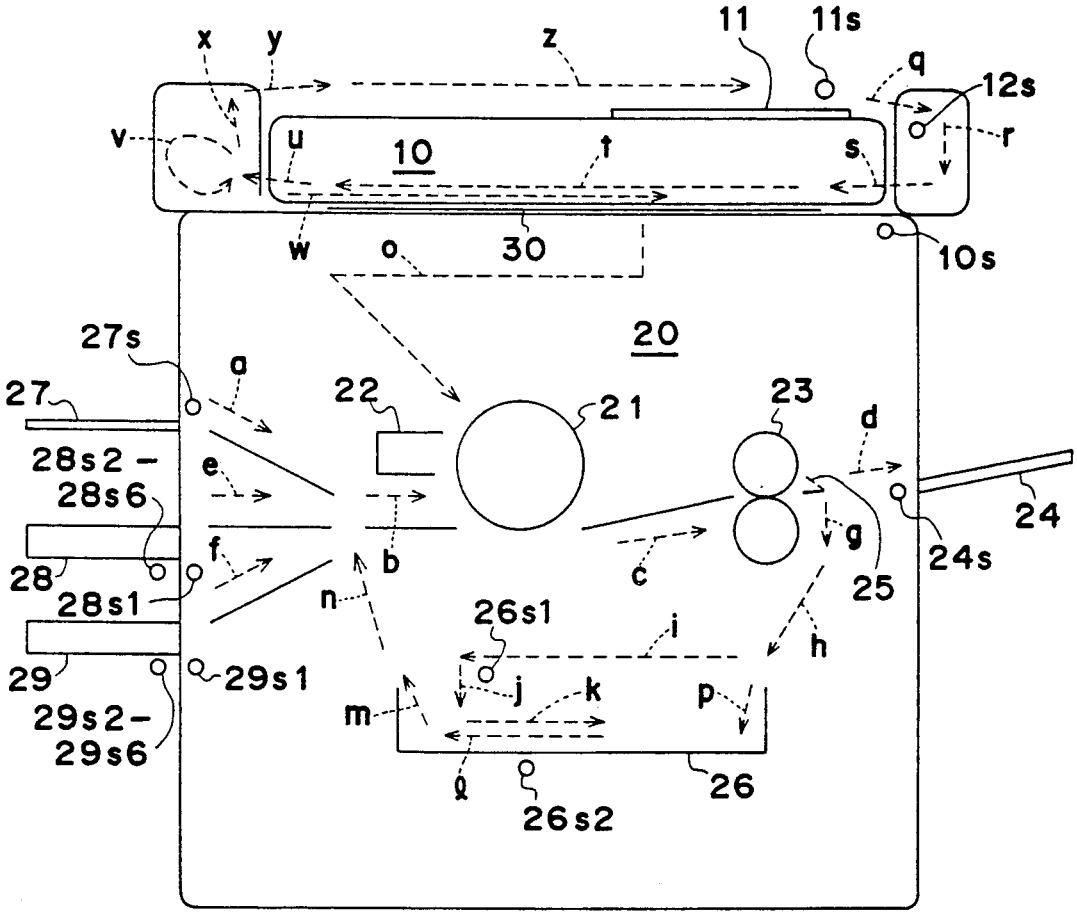
FIG. 1 is an illustration showing the construction of a copying apparatus according to an embodiment of the present invention.

Before the description of the present invention proceeds, it is to be noted that like parts are designated by like reference numerals throughout the accompanying drawings.

Referring to the accompanying drawings, a copying apparatus according to one preferred embodiment of the present invention is described below.

(1) Construction of copying apparatus

Figure 2:
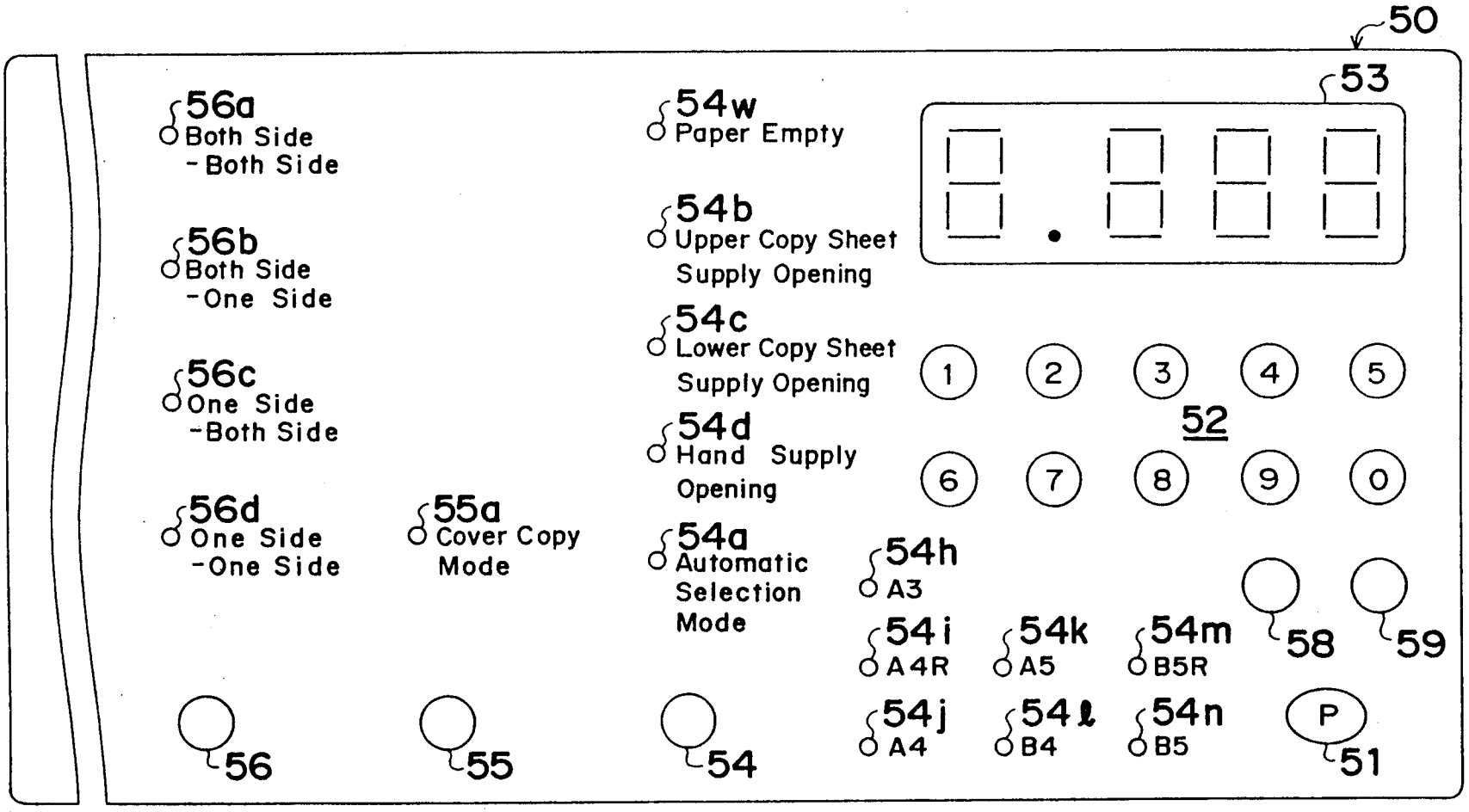
FIG. 2 is an explanatory view showing a part of an operation panel of the copying apparatus.
Figure 3:
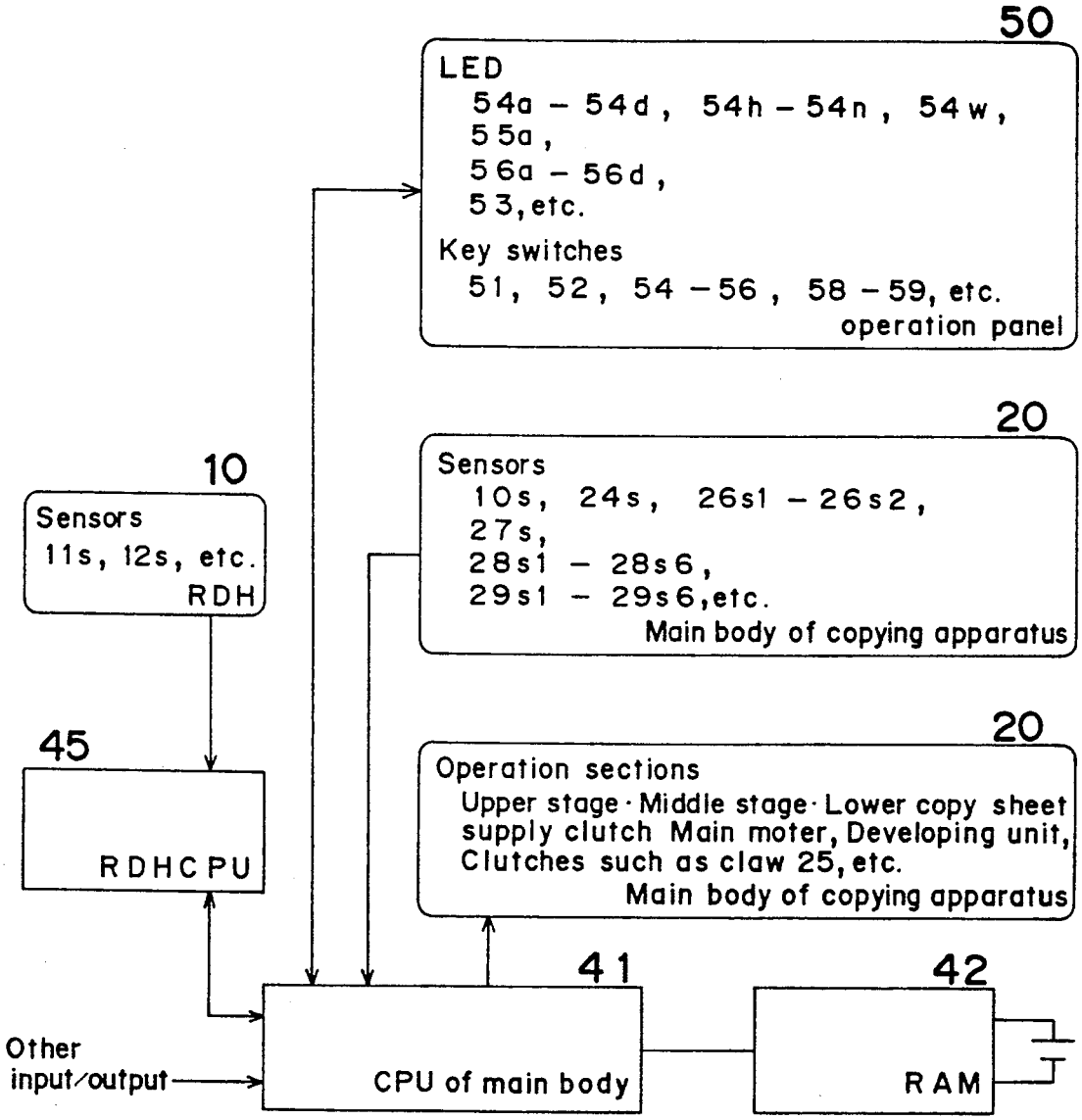
FIG. 3 is a block diagram showing the construction of a control circuit of the copying apparatus.

The construction of the copying apparatus is described with reference to FIGS. 1 through 3.

The copying apparatus comprises a main body 20 and a recirculation document handler (hereinafter referred to as RDH) 10 mounted on the main body 20, as shown in FIG. 1.

The RDH 10 automatically feeds original documents and counts the number (first page to Nth page) thereof. That is, the RDH 10 sequentially takes out original documents set on an original document tray 11, with the side having an image to be copied upward, from the lowermost sheet, in order of Nth page, $(N-1)$th page, $(N-2)$th page, . . . 2nd page and 1st page, according to a signal outputted from a CPU 41 of the main body 20 as shown in FIG. 3, thus feeding them to an original document setting glass 30 at a predetermined position thereof along a path t - r - s as shown by arrows of broken lines. Then, the image of each original document is scanned by an optical system. Thereafter, each original document is discharged from the RDH 10 along a path shown by arrows t - u - x - y of broken lines. Then, each original document is returned to the tray 11 along a path shown by an arrow z of broken lines. If each original document has an image to be copied on both sides thereof, the original document is fed from the tray 11 to the glass 30 along the path shown by arrows q - r - s of broken lines, and then fed into an inverting unit along a path shown by arrows t - u of broken lines, then inverted as shown by an arrow v of broken lines in the inverting unit. Thereafter, the original document is fed to the glass 30 again along a path shown by an arrow w of broken lines and set on the glass 30 at its predetermined scanning position at which the image of its second side, for example, the lower side of the original document is scanned by the optical system so as to copy the image of the second side on a copy sheet. Then, the original document is fed into the inverting unit again along a path shown by the arrow u of broken lines, and then inverted again to feed it to the glass 30 along the path shown by the arrow w of broken lines so as to set it on the glass 30 at its predetermined scanning position at which the image of its first side, for example, the upper side thereof is scanned by the optical system so as to copy the image of the second side on the copy sheet. Thus, the image of the second and first sides of the original document is copied on the copy sheet, and then the original document is discharged from the RDH 10 along the path shown by the arrows u - x - y of broken lines, thereafter, returned to the tray 11 along the path shown by the arrow z of broken lines. According to the RDH 10, the original document is automatically circulated along the predetermined path to scan the image thereof.

Upon detection of the original document set on the tray 11, a sensor 11*s* transmits a signal to the CPU 41 of the main body 20 via a CPU 45 (FIG. 3) of the RDH 10.

When a sensor 12*s* detects the original document discharged from the tray 11 in order to scan its image, it outputs a signal to the CPU 41 via the CPU 45 similarly to the sensor 11*s*. Thus, the number of original documents supplied from the tray 11 to the glass 30 is counted.

A sensor 10*s* detects whether or not the RDH 10 is electrically connected with the main body 20.

The main body 20 performs a copying operation by means of electrophotographic system. That is, the original document set on the glass 30 at its predetermined scanning position thereof is light-exposed and scanned by the optical system not shown. Light reflected by the image of the original document is guided to a photosensitive drum 21, uniformly charged and rotating at a constant speed, along a path shown by an arrow o of broken line so as to form an electrostatic latent image on the surface of the photosensitive drum 21. The electrostatic latent image is developed with toner by a developing unit 22. Then, the toner image is transferred to a copy sheet supplied from a copy sheet supply section to a transfer section at a predetermined timing. The transferred toner image is fixed to the copy sheet by a fixing device.

When an upper copy sheet supply opening is selected, a copy sheet is supplied from an upper paper supply cassette 28 to the transfer section along a path shown by arrows e - b of broken lines. The transfer section is positioned between the photosensitive drum 21 and a transfer charger not shown. Similarly, when a lower copy sheet supply opening is selected, a copy sheet is supplied from a lower copy sheet supply cassette 29 to the transfer section along a path shown by arrows f - b of broken lines. When a hand-supply section 27 is selected, a copy sheet set thereon is supplied therefrom to the transfer section along a path shown by arrows a - b of broken lines.

After the toner image of the original document is transferred to the copy sheet, the copy sheet is fed to a fixing device 23 along a path shown by an arrow c of broken line. After the toner image is fixed to the copy sheet, according to the set position of a claw 25, the copy sheet is discharged to a discharge tray 24 or accommodated in an intermediate tray 26 if image of the original document is to be copied on both sides of the copy sheet.

More specifically, when the claw 25 is set at a position shown by a solid line, the copy sheet is discharged to the discharge tray 24 along the upper surface of the claw 25. A sensor 24*s* is provided between the claw 25 and the discharge tray 24 so as to detect the copy sheet discharged.

When the claw 25 is set at a position shown by broken lines, the copy sheet is moved downward by the lower surface of the claw 25 into the tray 26 along a path shown by arrows g - h - i - j - k of broken lines with the image-formed side upward.

The tray 26 is used in both-side copy mode, i.e., the tray 26 accommodates the copy sheet having an image copied on one side thereof so that the image of a different original document, for example, the following page is copied on other side thereof subsequently. That is, the tray 26 supplies the copy sheet to the transfer section along a path shown by arrows l - m - n - b of broken lines in order to form an image on the other side thereof. If the image of a different original document is to be copied on the image-copied side of the copy sheet in a subsequent copying operation in order to make a composed images, the copy sheet is fed to the tray 26 along a path shown by arrows h - p of broken lines so that the copy sheet is accommodated in the tray 26 with its image-formed side downward. A sensor 26*s*is provided to detect the copy sheet being fed along the path i. A sensor 26*s*2 is provided to detect it when it is accommodated in the tray 26.

Sensor 28*s*1 and 29*s*1 are provided below the upper and lower copy sheet supply cassette 28 and 29, respectively to detect whether or not copy sheets are accommodated therein. Two groups of sensors 28*s*2 through 28*s*6 and 29*s*2 through 29*s*6 are provided alongside the sensors 28*s*1 and 29*s*1, respectively so as to detect the size of copy sheets accommodated in the cassettes 28 and 29 and distinguish the type of copy sheets, namely, distinguish a cassette which accommodates copy sheets for the cover page from a cassette which accommodates copy sheets for other pages, namely, original documents other than the cover page. Upon detection of the size or type of copy sheets, each of these sensors outputs a signal to the CPU 41. A sensor 27*s* for detecting copy sheets supplied by hand is positioned in the main body 20 such that the sensor 27*s* is in the vicinity of the copy sheet supply opening of the hand-supply section 27. A code corresponding to the size and type of each copy sheet accommodated in each cassette is generated according to a signal outputted from each sensor 28*s*2 through 28*s*6 and 29*s*2 through 29*s*6.

An operation panel 50 is mounted on the upper surface of the main body 20 of the above construction.

The following keys are provided on the operation panel 50: a print key 51 for instructing the start of a copy operation; ten-keys 52 for inputting a numerical value; a key 54 for selecting a copy sheet supply opening; a cover copy mode key 55 for instructing cover copy mode as a copy mode; a copy mode key 56 for selecting copy modes from among a mode in which an original document has an image on both sides thereof or on one side thereof, and a mode in which an image is copied on both sides of a copy sheet or on one side of the copy sheet; a key 58 for registering the number of original documents, inputted by the ten-key 52 and displayed in a numerical value indicating section 53, in a predetermined area of a RAM 42; and a mode resetting key 59. A signal generated as a result of the press of each key is inputted to the CPU 41.

Light emitting diodes (LEDs) for displaying the following modes set by the above-described keys are provided on the operation panel 50 in addition to the numerical value indicating section 53 for displaying the number of copy sheets on which the image of each of original documents is to be formed. These LEDs are turned on or off and flash on or off by a signal outputted from the CPU 41.

An LED 55*a* is turned on when the cover copy mode is selected. An LED 54*a* is turned on when the automatic copy sheet supply opening selection mode is selected. An LED 54*b* is turned on when the upper copy sheet supply opening is selected. An LED 54*c* is turned on when the lower copy sheet supply opening is selected. An LED 54*d* is turned on when the hand-supply opening is selected. LEDs 54*h* through 54*n* are turned on according to the size of a copy sheet accommodated in a cassette inserted into a selected copy sheet supply opening. An LED 54*w* flashes on and off when no copy sheets are detected in a selected copy sheet supply opening. LEDs 56*a* through 56*d* are turned on according to a selected copy mode.

A selected mode is stored in the RAM 42 backed up by a battery. In addition to each display control, the CPU 41 controls the operation to be performed by each section of the main body 20 such as the clutch of the claw 25 as shown in FIG. 3.

(2) Example of Copy Mode

An example of the above-described copy modes is described below.

(i) one-side original/both-side copy sheet (original document has an image on one side thereof and images are copied on both sides of one copy sheet)

N sheets of original documents consisting of one cover page, one page of table of contents, and (N−2) pages of content pages other than the cover page and the page of table of contents are set in the tray 11 of the RDH 10.

When N is even, the number of image-copied sheets is (N−2)÷2+2.

When N is odd, the number of image-copied sheets is (N−3)÷2+3.

When original documents are as shown in Table 1, the detail of image-copied sheets are as shown in Table 2 supposing that N is even. The image-copied sheet 1 in Table 2 is different from other image-copied sheets in the quality of paper.

TABLE 1

| | |
|---|---|
| cover | |
| | original document 1 |
| table | |
| | original document 2 |
| content page 1 | |
| | original document 3 |
| content page 2 | |
| | original document 4 |
| . | |
| . | |
| content page N-3 | |
| | original document N-1 |
| content page N-2 | |
| | original document N |

TABLE 2

| | |
|---|---|
| cover | |
| | copy sheet 1 |
| table | |
| | copy sheet 2 |
| content page 1 | |
| | copy sheet 3 |
| content page 2 | |
| content page 3 | |
| | copy sheet 4 |
| page 4 | |
| . | |
| . | |
| content page N-5 | |
| | copy sheet (N-4) ÷ 2 + 2 |
| content page N-4 | |
| content page N-3 | |
| | copy sheet (N-2) ÷ 2 + 2 |
| content page N-2 | |

ii) Both-side original/both-side copy sheet (original document has images on both sides thereof and images are copied on both sides of one copy sheet)

N sheets of original documents consisting of one original document in which the upper side is the cover and the lower side is the table of contents and (N−1) content sheets each having an image on both sides thereof are set in the tray 11 of the RDH 10. The number of image-copied sheets are N+1.

When the original document is as shown in Table 3, the detail of image-copied sheets are as shown in Table 4. The image-copied sheet 1 is different from that of other image-copied sheets in quality.

TABLE 3

| | |
|---|---|
| cover | |
| | original document 1 |
| table | |
| content page 1 | |
| | original document 2 |
| content page 2 | |
| content page 3 | |
| | original document 3 |
| content page 4 | |
| content page 2N-5 | |
| | original document N-1 |
| content page 2N-4 | |
| content page 2N-3 | |
| | original document N |
| content page 2N-2 | |

TABLE 4

| | |
|---|---|
| cover | |
| | copy sheet 1 |
| table | |
| | copy sheet 2 |
| content page 1 | |
| | copy sheet 3 |
| content page 2 | |
| content page 3 | |
| | copy sheet 4 |
| content page 4 | |
| . | |
| . | |
| content page 2N-5 | |
| | copy sheet N |
| content page 2N-4 | |
| content page 2N-3 | |
| | copy sheet N + 1 |
| content page 2N-2 | |

(3) Control to Performed by Copying Apparatus

The control regarding the apparatus is described with reference to FIGS. 4 through 14. "On edge" hereinafter used means the condition change of a signal from "OFF" to "ON".

Figure 4:
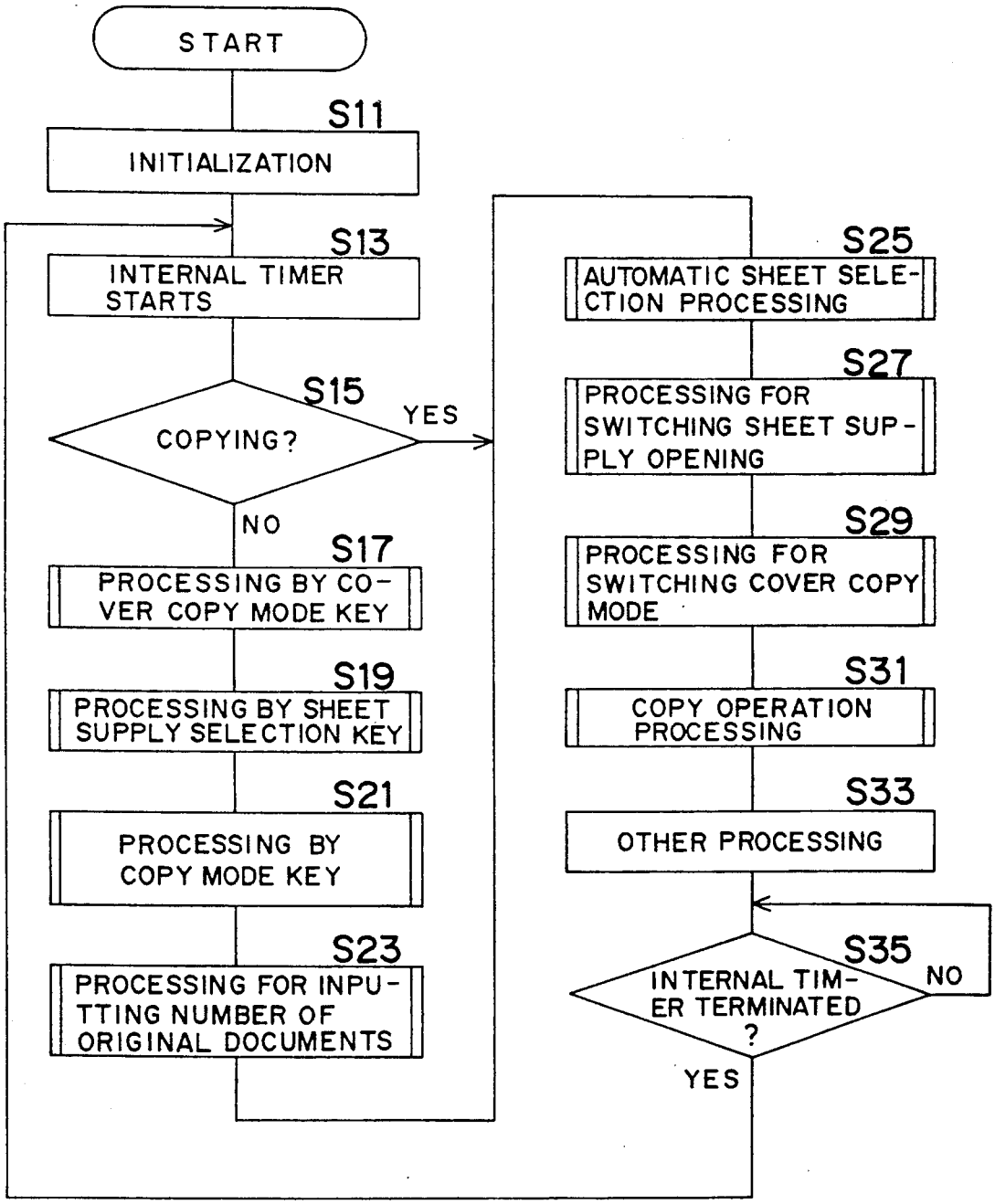

(i) Main routine; FIG. 4

When the apparatus is switched on, the CPU 41 executes an initialization. For example, the CPU 41 clears the RAM 42 to zero at step S11. Then, a loop processing is repeatedly conducted from step S13 to step S35. That is, an internal timer for controlling the execution time of one routine is started at step S13. The steps in FIG. 4 are as follows.

* Processing by cover copy mode key (step S17)

The processing of this mode is executed when a copy operation is not being performed. Each time the cover copy mode key 55 is pressed, the cover copy mode is executed or cancelled. The detail of this processing is described later.

* Processing by key for selecting copy sheet supply opening (step S19)

The processing of this mode is executed when a copy operation is not being performed. Each time the key 54 for selecting a copy sheet supply opening is pressed, copy sheet supply openings are changed from one to the other. The detail of the processing is described later.

* Processing by copy mode key (step S21)

The processing of this mode is executed when a copy operation is not being performed. Each time the copy mode key 56 is pressed, copy mode is switched. The detail of the processing is described later.

* Processing for inputting number of original documents (step S23)

The processing of this mode is executed when a copy operation is not being performed. A numerical value inputted by the key of the operation panel 50 is registered as the number of original documents. The detail of the processing is described later.

* Automatic copy sheet selection processing (step S25)

In automatic copy sheet selection mode, the size of a copy sheet is calculated according to the size of an original document and magnification so as to select a copy sheet supply opening for a copy sheet of a determined size. The detail of the processing is described later.

* Copy sheet supply opening switching processing (step S27)

The processing of this mode is to switch the discharge of a copy sheet between the image-copied sheet discharge side and the copy sheet accommodating side and copy sheet supply openings from one to the other. The detail of the processing is described later.

* Processing for switching discharge side of copy sheet in cover copy mode (step 29)

In the cover copy mode, the discharge of a copy sheet is switched between the image-copied sheet discharge side and the copy sheet accommodating side before the image of the last page and the page one page prior to the last page are copied. The detail of the processing is described later.

* Copy operation processing (step S31)

Controls necessary for performing a copy operation are made when the conditions for the copy operation are satisfied. The detail of the processing is described later.

* Other processing (step S33)

Other processings means processings other than all of the above processings to be executed by the CPU 41.

After each of the above-described processings S11–33 is conducted, the termination of the operation of the internal timer is waited at step S35. Then, the program returns to step S13 to repeat the above processings.

Each subroutine is described below.

Figure 5:
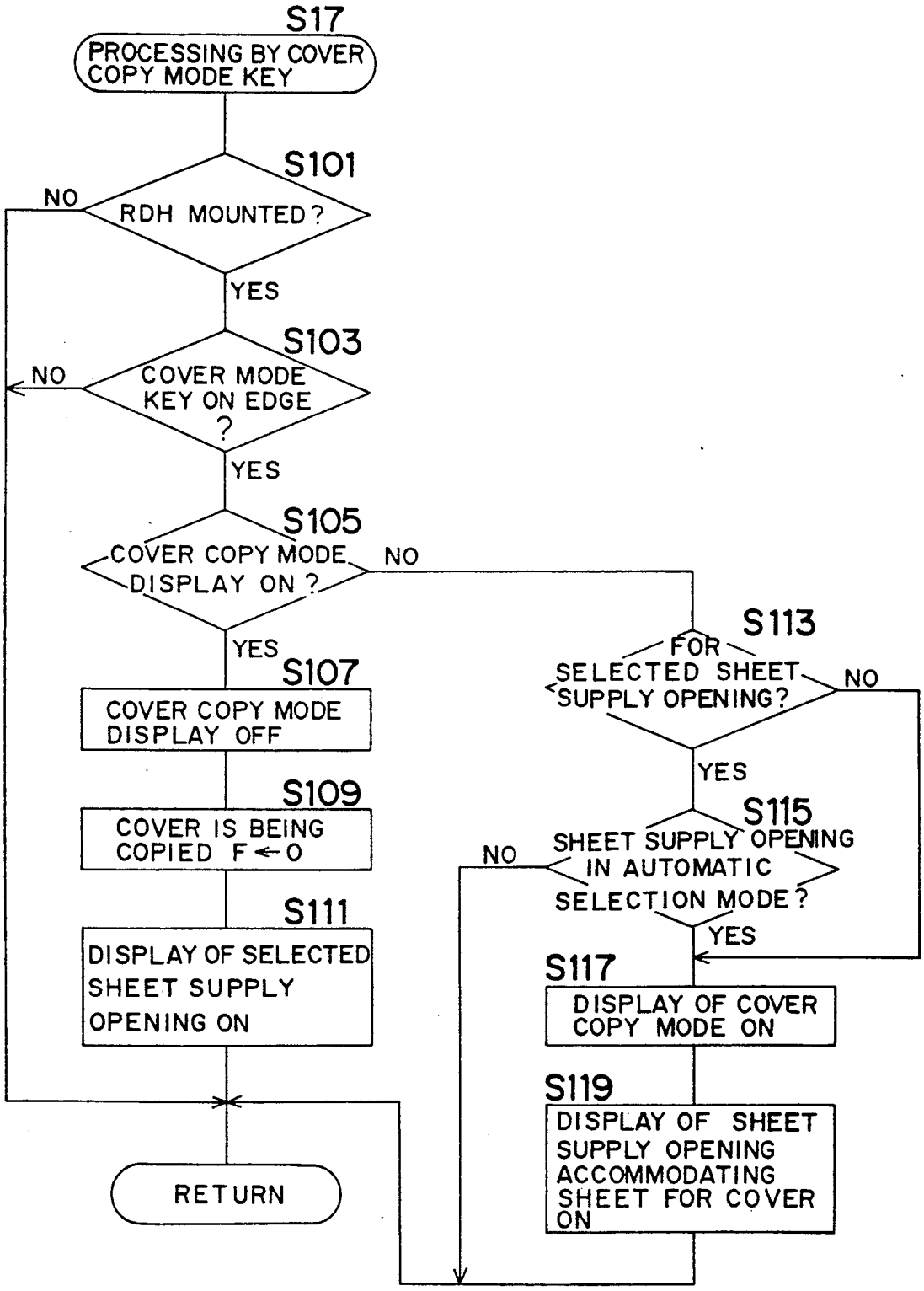

(ii) Processing by cover copy mode key: FIG. 5

The processing by the cover copy mode key (step S17) is executed if it is decided at step S101 that the RDH 10 is mounted on the main body 20.

If it is decided at step S103 that ON-EDGE of a signal is detected as a result of the press of the cover copy mode key 55, the program goes to step S105. If it is decided at step S105 that the cover copy mode indicating LED 55*a* is turned on, the cover copy mode is released and the cover copy mode indicating LED 55*a* is turned off at step S107 and a flag indicating that the image of the cover page of a series of original documents is being copied is reset to "0" at step S109. At step S111, one of the LEDs 54*b* through 54*d* is turned on so that a selected copy sheet supply opening is indicated.

If it is decided at step S105 that the cover copy mode is cancelled after ON-EDGE of the signal is detected and the cover copy mode indicating LED 55*a* is turned off, the program goes to step S113 at which it is decided whether or not the selected copy sheet supply opening is appropriate for the copy sheet for the cover. If no at step S113, the program goes to step S117 at which the cover copy mode is set and the LED 55*a* is turned on and one of the LEDs 54*b* through 54*d* is turned on at step S119. If it is decided at step S113 that the copy sheet supply opening for the cover is selected and it is decided at step S115 that the automatic copy sheet supply opening selection mode is set, the cover copy mode is set at step S117 and one of the LEDs 54*b* through 54*d* is turned on at step S119.

Figure 6B:
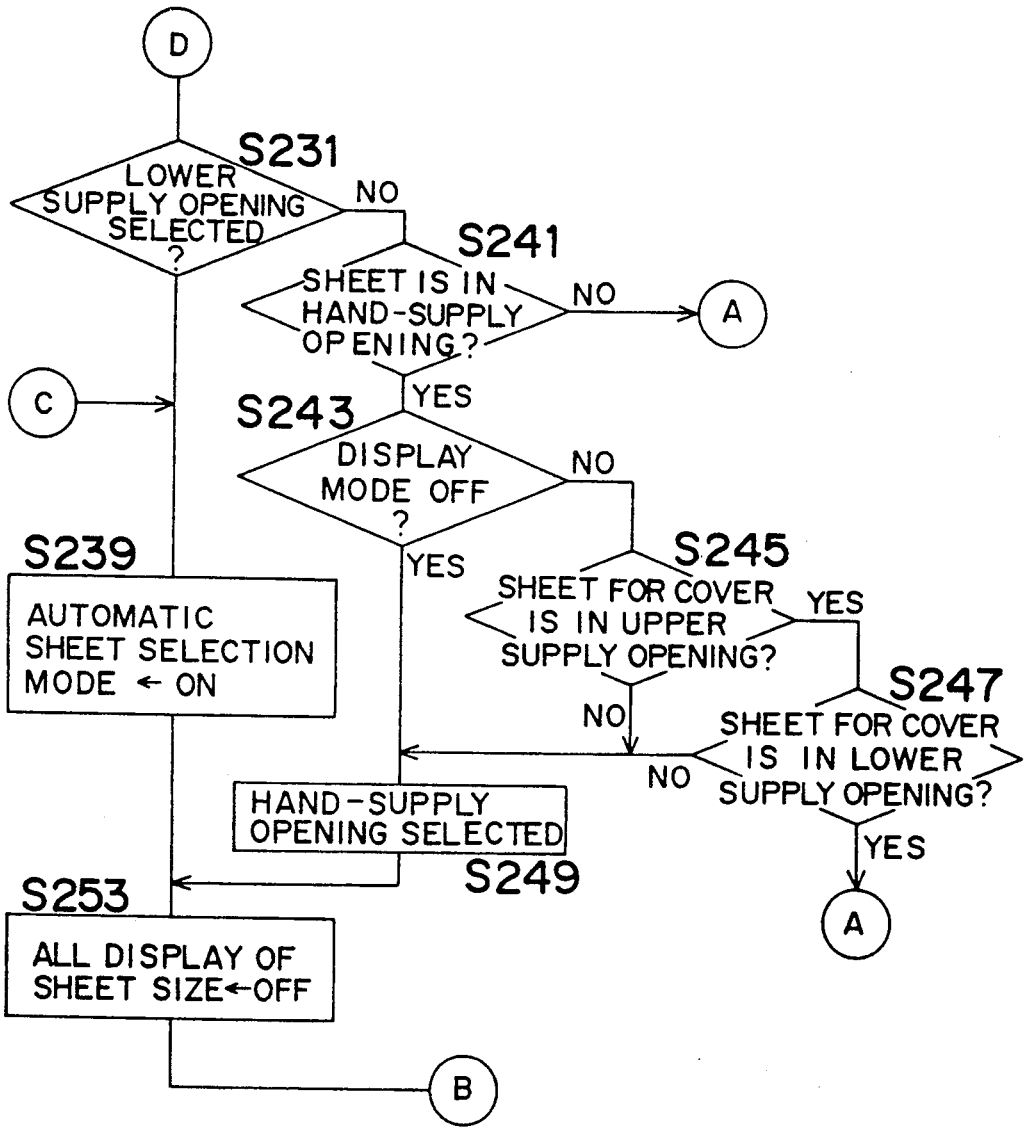

(iii) Processing to be executed by copy sheet supply opening selection key: FIG. 6

The processing (step S19) is executed when the key 54 for selecting a copy sheet supply opening is pressed and if it is decided at step S201 that ON-EDGE of a signal generated as a result of the pressing of the key 54 is detected. The copy sheet supply openings are sequentially switched over, for example, from upper opening lower opening - automatic copy sheet selection mode - hand-supply opening - upper opening - . . . .

If it is decided at step S211 that the hand-supply opening is currently selected, principally, the upper copy sheet supply opening is selected at step S219 as far as the cover copy mode is not set or a cassette accommodating a copy sheet for the cover is not inserted into the upper copy sheet supply opening even though the cover copy mode is set, namely, yes, at step S213 and no, at step S217. If it is decided at step S217 that the cassette accommodating the copy sheet for the cover is inserted into the upper supply opening, principally, the lower supply opening is selected at step S229.

If it is decided at step S221 that the upper supply opening is currently selected, principally, the lower supply opening is selected at step S229 on condition that it is decided at step S223 that the cover copy mode is not set or it is decided at step S225 that the cassette accommodating the copy sheet for the cover is inserted into the upper supply opening even though the cover copy mode is set or the cassette accommodating the copy sheet for the cover is not inserted into the lower supply opening. If it is decided at step S227 that the cassette inserted into the lower supply opening accommodates the copy sheet for the cover, the automatic copy sheet selection mode (automatic copy sheet supply opening selection mode) is set at step S239.

If it is decided at step S231 that the lower supply opening is selected, the automatic copy sheet selection mode is set at step S239.

If it is decided at step S231 that neither the hand-supply opening nor the upper supply opening nor the lower supply opening is selected and if it is decided at step S241 that the copy sheet are set on the hand-supply opening and the sensor 27*s* is turned on, the hand-supply opening is selected at step S249. The above flow is executed if it is decided at step S243 that the cover copy mode is not set or at step S245 that the cassette accommodating the copy sheet for the cover is inserted into the upper supply opening even though the cover copy mode is set or at step S247 that the cassette accommodating the copy sheet for the cover is inserted into the lower supply opening even though the cover copy mode is set. If it is decided at step S247 that the cassette accommodating the copy sheet for the cover is inserted neither into the upper supply opening nor into the lower supply opening, principally, the upper supply opening is selected at step S219.

After one of the copy sheet supply openings is selected or the automatic copy sheet selection mode is set, one of the LEDs 54*h* through 54*n* indicating the size of the copy sheet set in the selected supply opening is turned on at step S251. When the automatic copy sheet selection mode or the hand-supply opening is selected, the size of the copy sheet cannot be identified. Therefore, all the LEDs 54*h* through 54*n* indicating the size of the copy sheet are turned off at step S253. Then, one of the LEDs 54*a* through 54*d* indicating a selected copy sheet supply opening is turned on at step S261. If it is decided at step S263 that the cover copy mode is set, one of the LEDs 54*a* through 54*d* is turned on at step S265.

Figure 7:
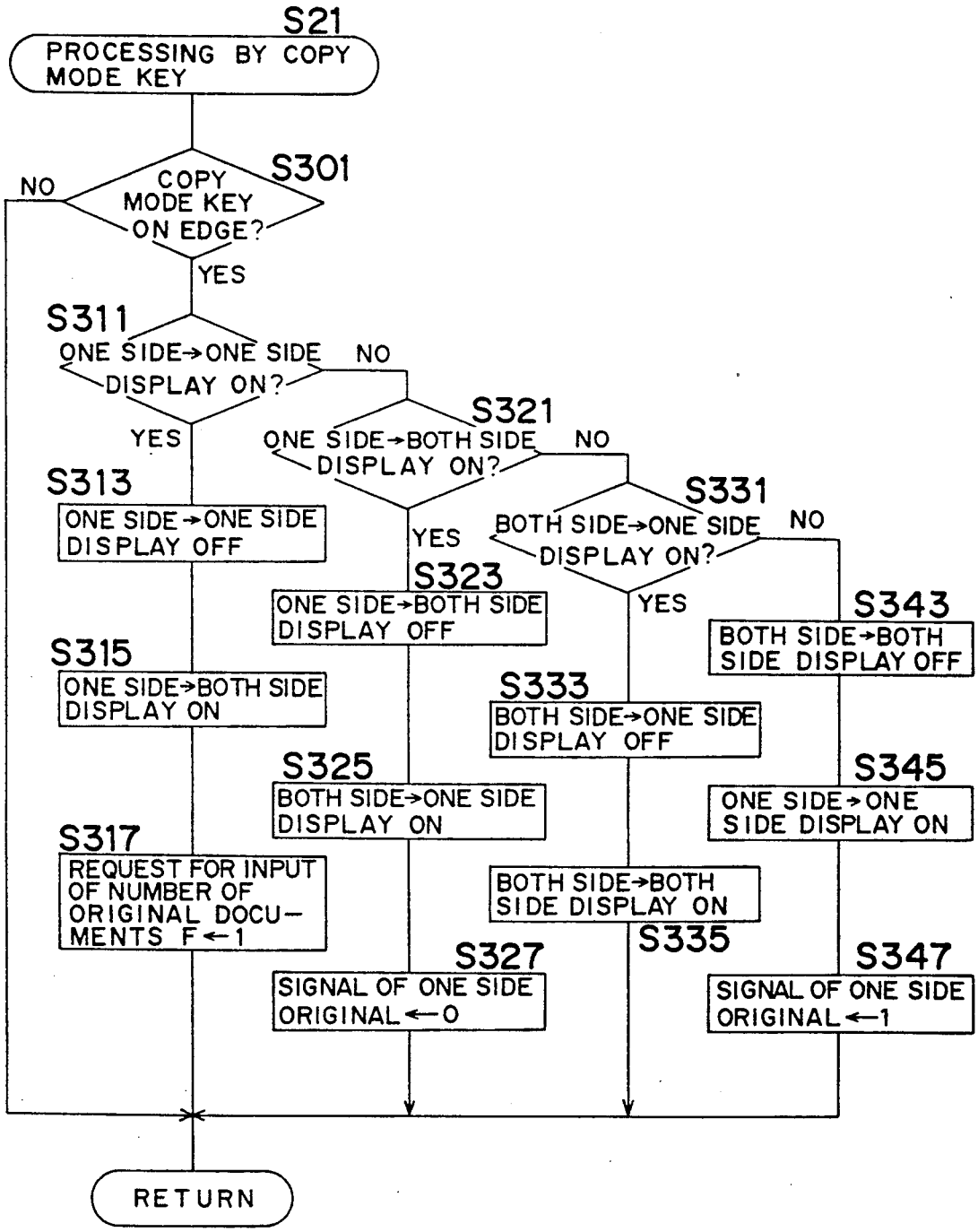

(iv) Processing to be executed by copy mode key: FIG. 7

The processing (step S21) by the copy mode key 56 is executed if ONEDGE of a signal generated as a result of the pressing of the copy mode key 56 is detected at step S301. The copy mode is sequentially switched from, for example, one side/one side - one side/both sides - both-side/one side - both-side/both-side - one side/one side.

If it is decided at step S311 that the copy mode of one side/one side is set at the ON-EDGE of the signal, the LED 56*d* indicating the mode of one side/one side is turned off to cancel the copy mode of one side/one side at step S313, and the LED 56*c* indicating the mode of one side/both-side is turned on to select the mode of one side/both-side at step S315. Then, a flag indicating an input request for the number of original documents is set to "1" at step S317. Thus, the wait state of the input of the number of original documents is set.

Similarly, if it is decided at step S321 that the mode of one side/both-side is set, the mode of both-side/one side is set at steps S323 and S325. Then, at step S327, a signal indicating that the original document has an image on one side is transmitted to the CPU 45 of the RDH 10 by resetting the signal to "0". As a result, the RDH 10 inverts the original document in the inverting unit as shown by the arrow v of broken lines in FIG. 1, thus feeding it to the glass 30 so that the images of both sides of the original document are copied.

Similarly, if it is decided at step S331 that the mode of both-side/one side is set, the mode of both-side/both-side is set at steps S333 and S335.

Similarly, if it is decided at step S331 that the mode of both-side/both-side is set, the mode of one side/one side is set at steps S343 and S345. Then, a signal indicating that the original document has an image on one side is transmitted to the CPU 45 of the RDH 10 by setting the signal to "1" at step S347. As a result, the RDH 10 regards that the original document has an image on one side, thus setting it on the glass 30 without inverting it so as to perform a one side/one-side copy operation.

Figure 8:
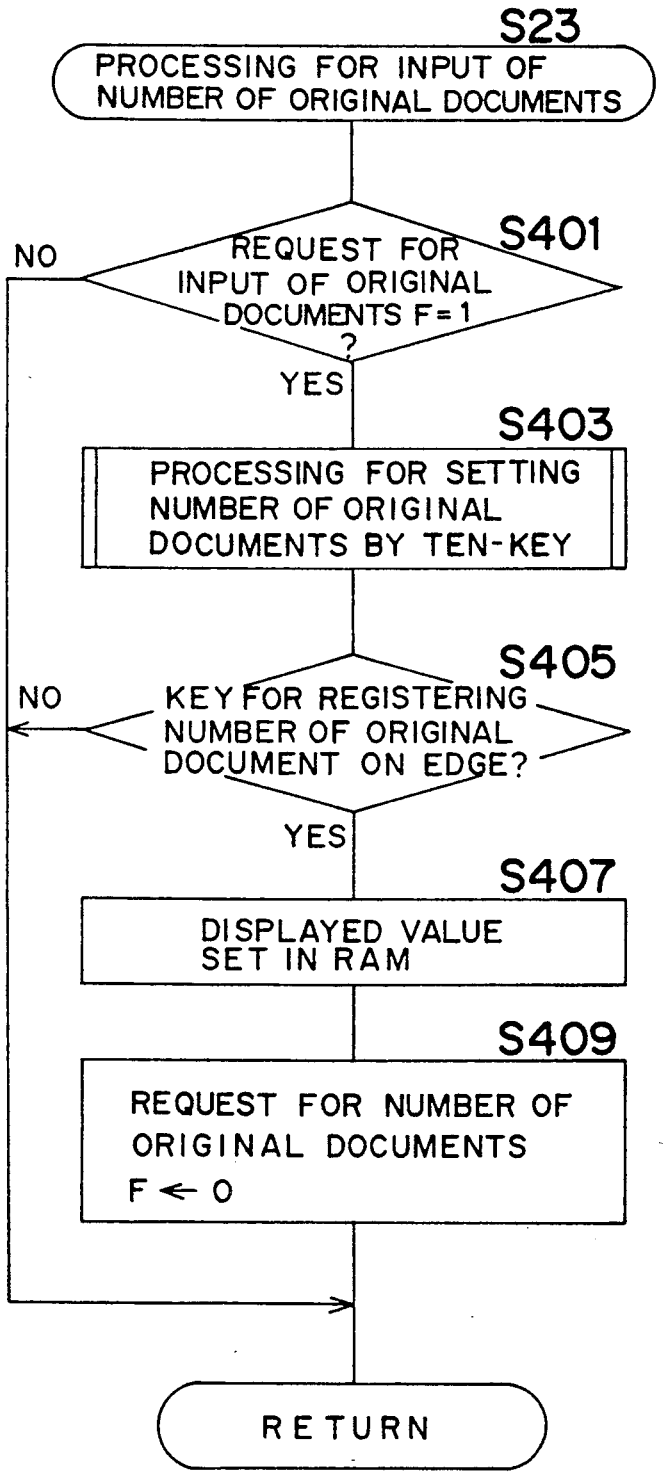

(v) Processing for inputting the number of original documents: FIG. 8

Processing (Step S23) for inputting the number of original documents is conducted if it is decided at step S401 that the flag indicating the input request for the number of original documents is set to "1" (refer to step S317 of FIG. 7).

First, at step S403, processing for setting the number of original documents is executed and a numerical value inputted by the ten-keys 52 is processed as data of the number of original documents and the numerical value is displayed in the numerical value display section 53. If it is decided at step S405 that ONEDGE of a signal generated as a result of the press of the key 58 for registering the number of original documents is detected, the numerical value displayed in the numerical value display section 53 is stored in the RAM 42 at step S407. Then, at step S409, the flag indicating the input request for the number of original documents is reset to "0" and the wait state for the input of the number of original documents is cancelled.

Figure 9A:
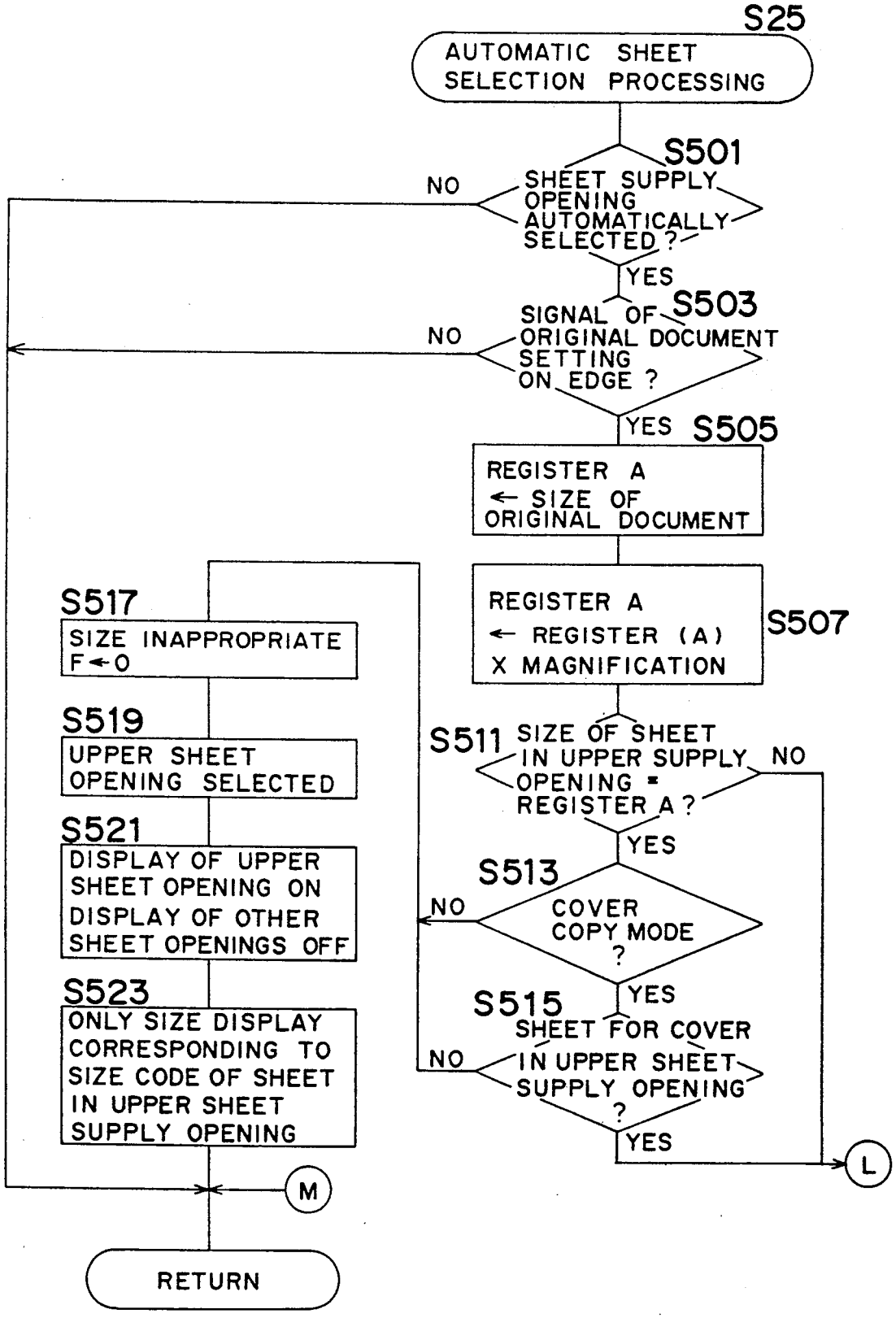
FIGS. 9A and 9B show the subroutine of automatic copy sheet selection processing.
Figure 9B:
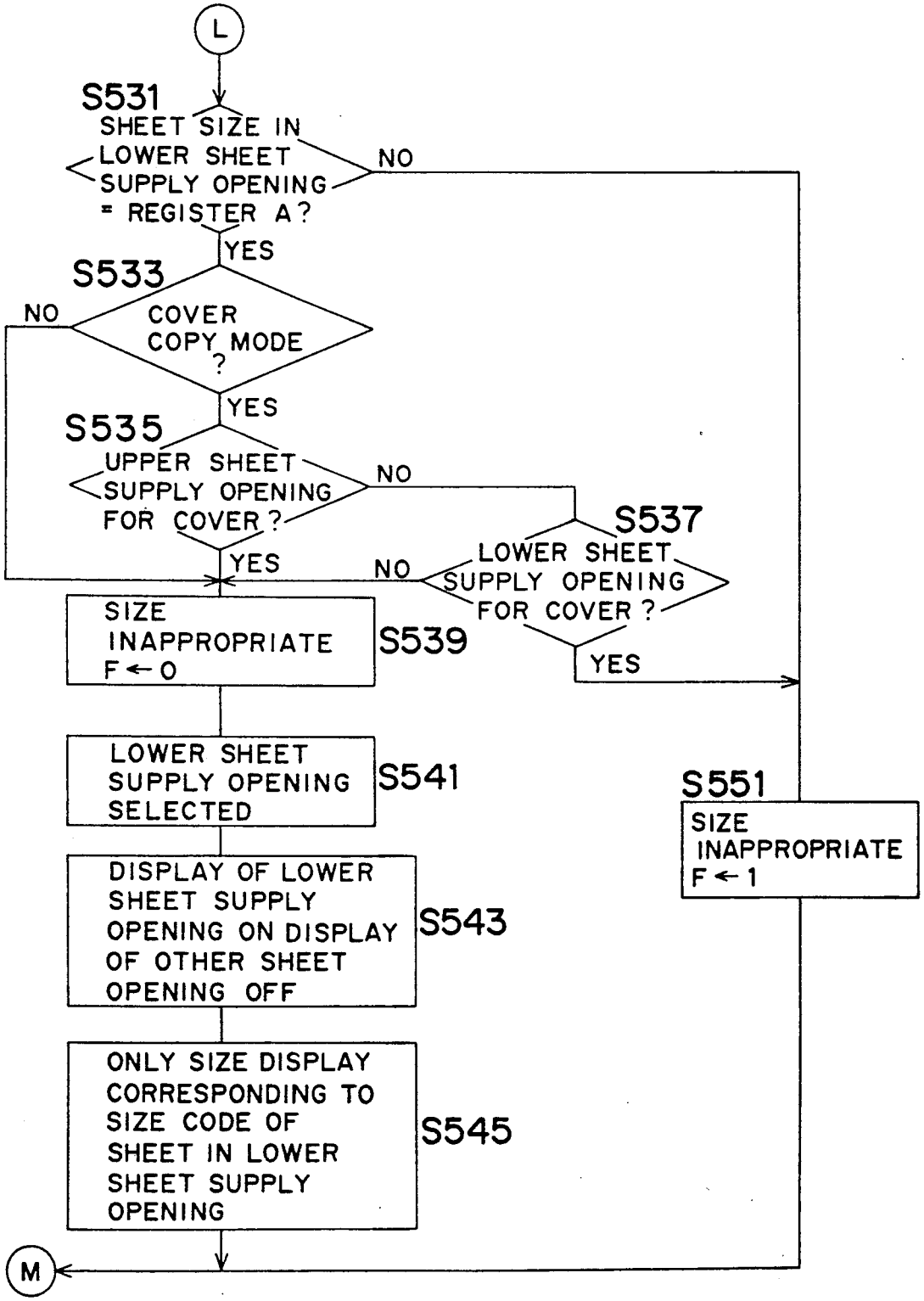

(vi) Automatic copy sheet selection processing FIGS. 9A and 9B

The automatic copy sheet selection processing (step S25) is executed if it it is decided at step S501 that the automatic copy sheet selection mode is set (refer to step S239) and that ONEDGE of a signal which is generated as a result of the setting of the original document on the tray 11 and to be transmitted from the CPU 45 of the RDH 10 to the CPU 41 is detected.

First, the data of the size of the original document set in the tray 11 is stored in the register A of the CPU 41 at step S505. That is, the CPU 45 calculates the size of the original document according to the state of switches which or turned on and off by an original document regulating plate (not shown) of the tray 11, thus transmitting a signal of a calculated result to the CPU 41.

Then, at step S507, the size data is multiplied by a copy magnification value selected by a magnification key not shown and the content of the register A is updated by a value obtained by the multiplication. Thus, the data of a required size of a copy sheet is stored in the register A of the CPU 41.

Thereafter, a supply opening is searched from the upper supply opening to the lower supply opening to select a supply opening in which a cassette accommodating the copy sheet of the required size is inserted on condition that the cassette accommodating the copy sheet for the cover is not set in the selected supply opening.

For example, if it is decided at step S511 that the upper cassette 28 accommodates the copy sheet of the required size, a flag indicating that size of copy sheet is inappropriate is reset to "0" at step S517 and then, the upper supply opening is selected at step S519 on condition that it is decided at step S513 that the cover copy mode is not set and at step S515 that the cassette accommodating the copy sheet for the cover is not inserted into the upper supply opening even though the cover copy mode is set. At step S521, the LED 54*b* indicating that the upper supply opening has been selected is turned on and one of the LEDs 54*h* through 54*n* indicating the size of the copy sheet accommodated in the upper supply cassette 28 is turned on at step S523.

If it is decided at step S531 that the lower cassette 29 accommodates the copy sheet of the required size, similar processing is conducted at step S531 through step S545.

If it is decided at step S531 that neither the upper cassette nor the lower cassette accommodates copy sheets of the required size, the flag indicating that size is inappropriate is set to "1" at step S551.

Figure 10:
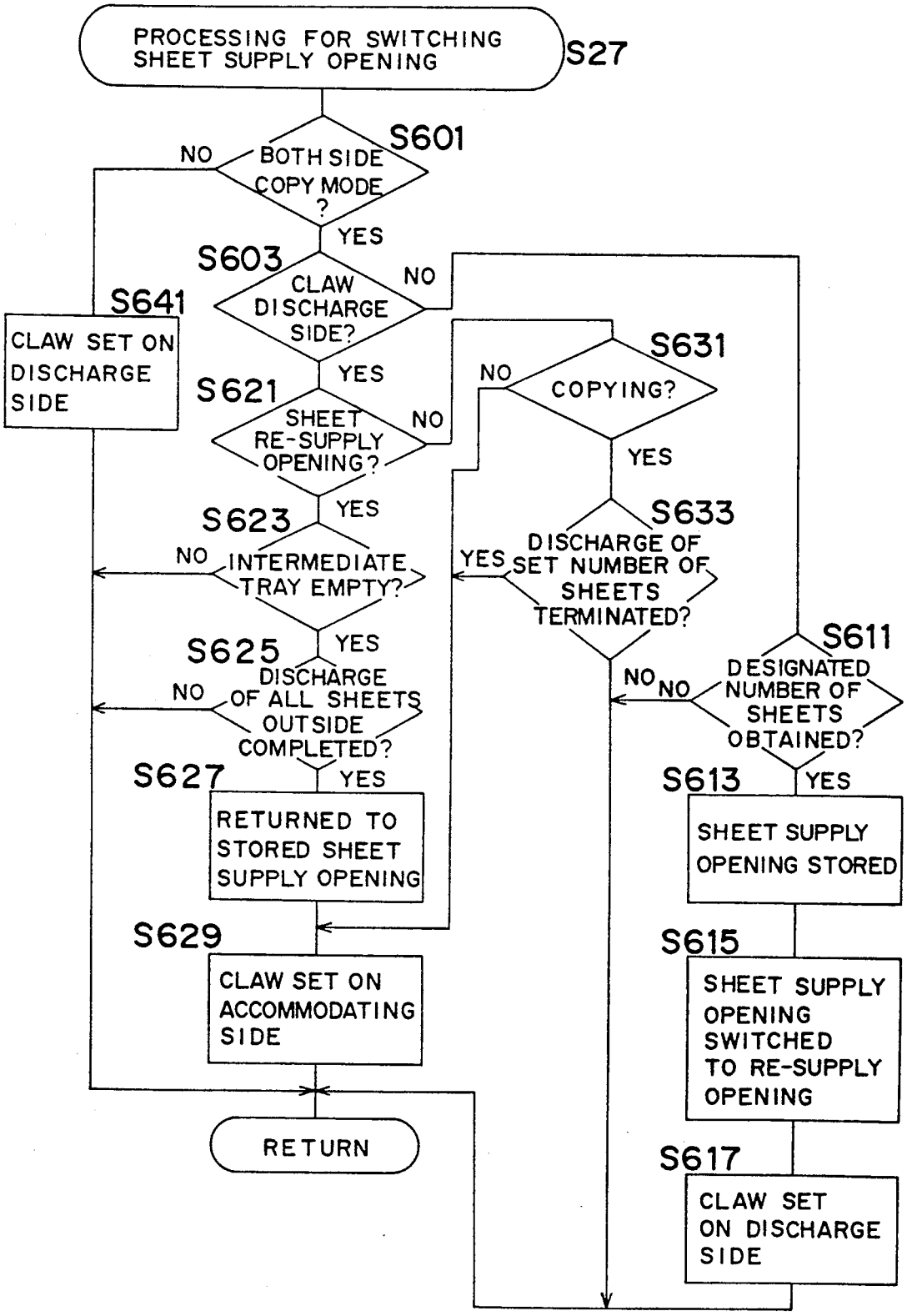

(vii) Processing for switching copy sheet supply opening: FIG. 10

If it is decided at step S601 that both-side copy mode is not set, the claw 25 is set at the discharge side to discharge an image-copied sheet to the discharge tray 24 at step S641.

If it is decided at step S601 that both-side copy mode is set, it is decided at step S603 whether the claw 25 is on the copy sheet discharge side or the copy sheet accommodating side. The claw 25 is set on the copy sheet discharge side in the initial condition.

If it is decided at step S603 that the claw 25 is set on the discharge side and at step S621 that one of the upper supply opening, the lower supply opening or hand-supply opening is set and at step S631 that a copy operation has not been started, the claw 25 is set on the copy sheet accommodating side. Thus, the preparation for copying the image of an original document on the first side, for example, the upper side of the copy sheet is completed.

If it is decided at step S603 that the claw 25 is set on the copy sheet accommodating side, the supply opening currently used is stored at step S613 after the designated number of image-copied sheets are obtained (copy on the first side of copy sheet) at step S611. It is to be noted that the above supply opening is not a copy sheet re-supply opening, but the upper supply opening, the lower supply opening or hand-supply opening. Then, at step S615, the supply opening is switched to the re-supply opening at step S615 and the claw 25 is set on the copy sheet discharge side at step S617. Thus, the preparation for copying the image of the original document on the second side of the copy sheet is completed.

If it is decided at step S603 that the claw 25 is set on the copy sheet discharge side and at step S621 that a copy sheet re-supply opening is set, the termination of an operation for forming the image of each original document on the second side of each copy sheet is waited and it is decided at step S623 whether or not the intermediate tray 26 is empty of copy sheets. If it is decided at step S625 that copy sheets having the image printed on the second side thereof are all discharged to the discharge tray 24, the supply opening stored at step S613 is reset at step S627, and the claw 25 is set on the copy sheet accommodating side at step S629. Thus, an operation for copying the image of each original document on the first side of each copy sheet is prepared.

Thus, the preparation for copying the image of the original document on the first side of the original document - second side thereof - first side thereof is carried out by appropriately switching the copy sheet supply opening and the position of the claw 25.

At step S633, processing is performed as a result of the processing executed at steps at step S714 (yes) and step S717.

That is, when the total number of original documents is odd in the one side/both-side copy mode, the image of an N-th original document (original document fed first from the tray 11 to the glass 30) is copied on one side of a copy sheet, and the image of the (N−1)th original document is copied on the first side of the other copy sheet. Therefore, it is necessary to set the claw 25 on the copy sheet discharge side.

Figure 11:
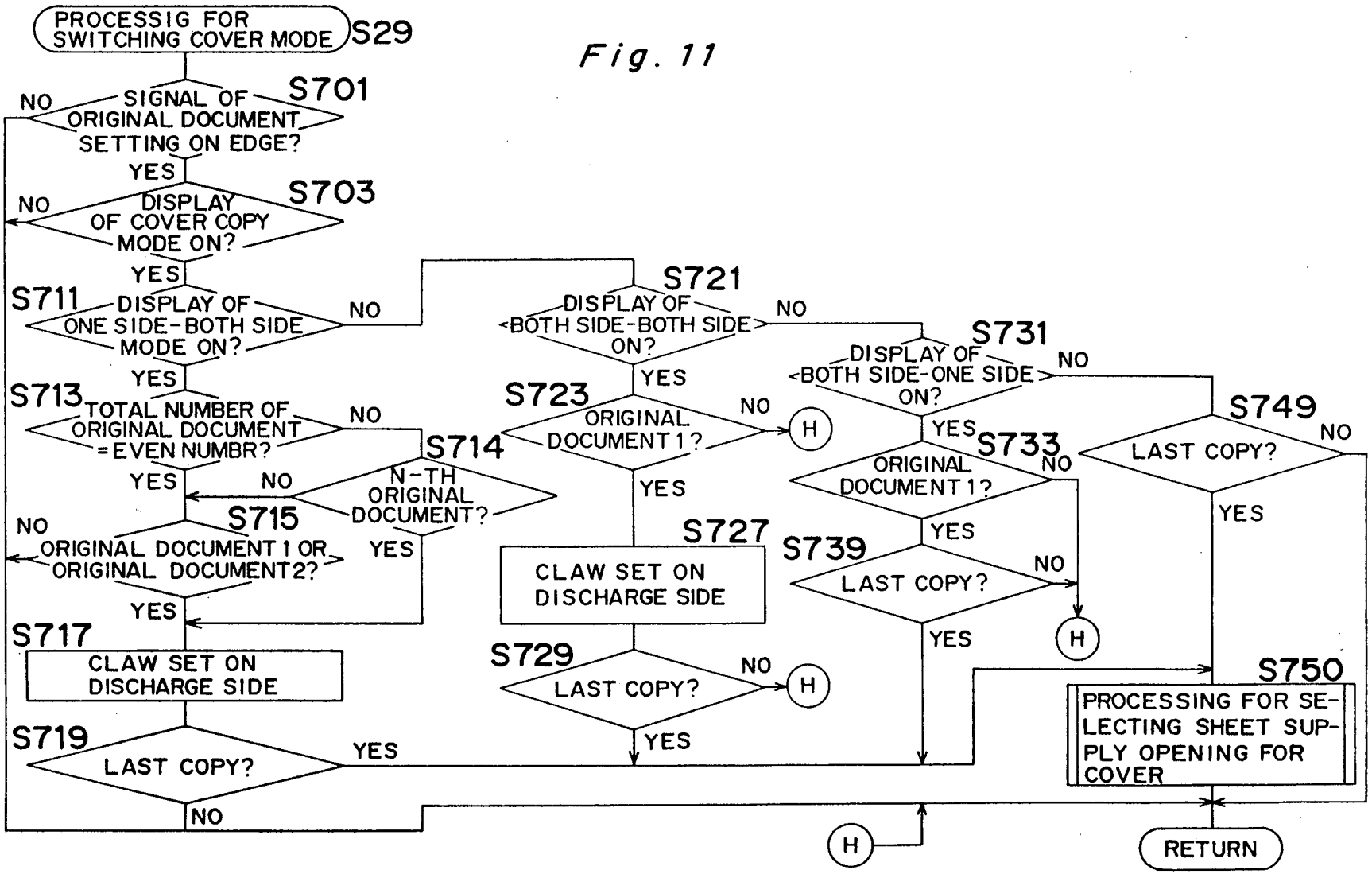
Figure 12:
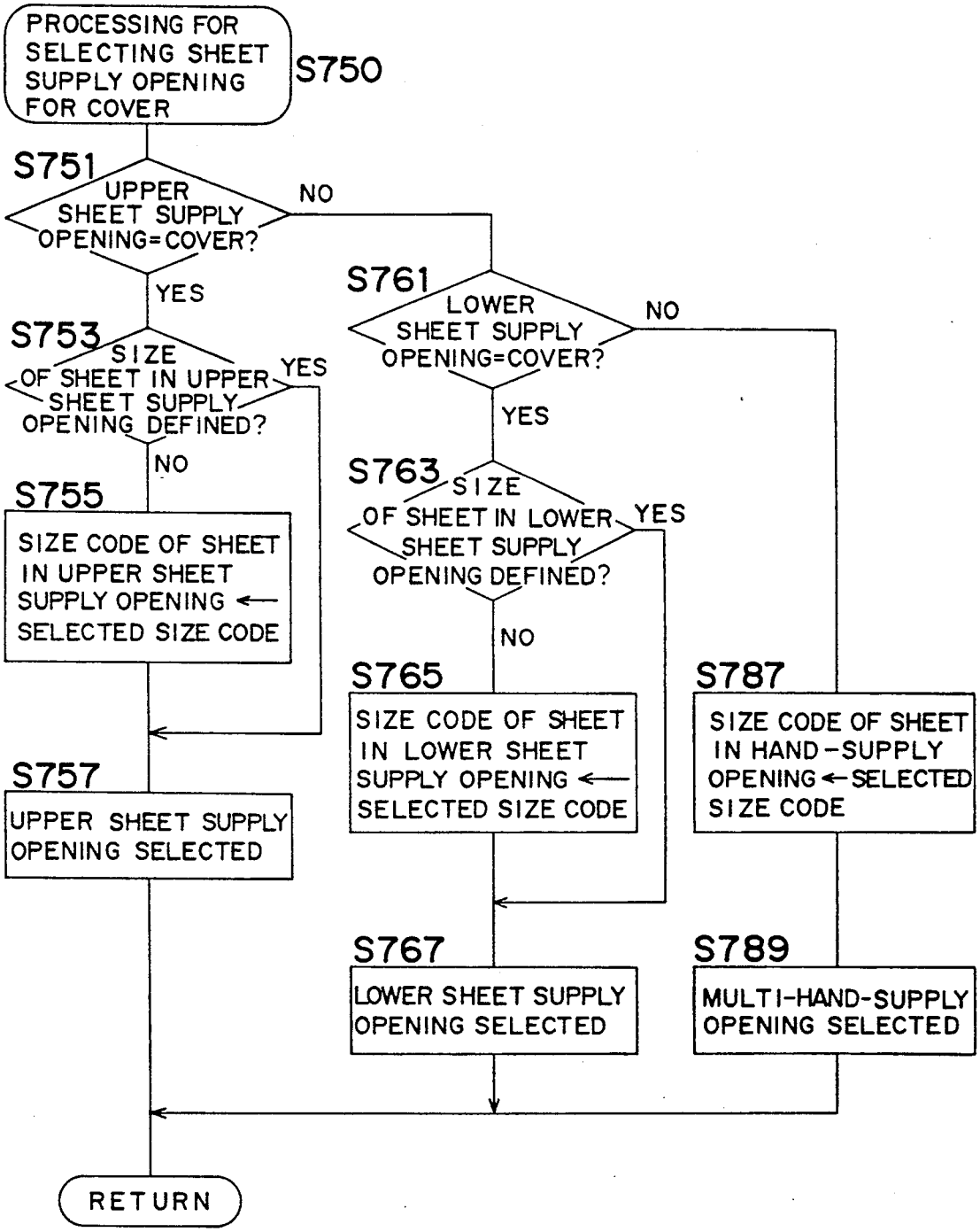

(viii) Cover mode switching processing: FIG. 11

If it is decided at step S701 that ONEDGE of a signal generated as a result the setting of original documents on the glass 30 is detected and at step S703 that the cover copy mode is set, the following processing is executed based on the copy mode.

* one side/both-side mode (yes, at step S711)

If it is decided at step S713 that the total number of original documents is even, the claw 25 is set on the discharge side at step S717 to copy the image of an original document 1 fed last from the tray 11 to the glass 30 and an original document 2 fed second last from the original document fed last. That is, both-side copy operation is prohibited.

If it is decided at step S713 that the total number of original documents is odd, the claw 25 is switched to the discharge side at step S717 to copy the image of an original document N fed first and the original documents 1 and 2 so as to prohibit a both-side copy operation. The reason for prohibiting the both-side copy operation is to prevent the image of the first page (page next to the table of contents) from being copied on the second side of the copy sheet.

If it is decided at step S719 that the image of the original document 1 is copied, processing for selecting the supply opening of a copy sheet for the cover is performed at step S750.

* both-side/both-side copy mode (yes, at step S721)

The claw 25 is set on the discharge side at step S727 if it is decided at step S723 that the image of the original document 1 (cover and table of contents) is copied to prohibit a both-side copy operation.

If it is decided at step S729 that the image of the final page, namely, the cover page is copied, processing for selecting the supply opening for the copy sheet for the cover page is executed at step S750.

* both-side/one side mode (yes, at step S731)

If it is decided at step S733 that the image of the original document 1 fed last from the tray 11 to the glass 30, i.e. the first page original document is copied, processing for selecting the supply opening for the copy sheet for the cover is executed at step S750.

* one side/one side copy mode (yes, at step S749)

If it is decided at step S749 that the image of the original document 1 fed last from the tray 11 to the glass 30 is copied, processing for selecting the supply opening for the copy sheet for the cover is executed at step S750.

The detailed description of the processing (step S750 in FIG. 12) for selecting the supply opening for the copy sheet for the cover is made below.

If it is decided at step S751 that a cassette accommodating the copy sheet for the cover is inserted into the upper supply opening, the upper supply opening is selected at step S757. If it is decided at step S753 that the size code of the copy sheet in the upper supply opening is not defined, a signal indicating the code of the size of the copy sheet in the supply opening (supply opening for copy sheet other than for the cover) selected currently is outputted at step S755. This is because it is likely that the copy sheet in the supply opening selected currently corresponds to the size of the copy sheet for the cover.

Similarly, if it is decided at step S761 that the cassette accommodating the copy sheet for the cover is inserted into the lower supply opening, the lower supply opening is selected at step S767. If it is decided at step S763 that the code of the size of the copy sheet in the lower supply opening is not defined, the size code of the copy sheet in the supply opening selected currently is outputted at step S765.

If it is decided at step S761 that neither the cassette inserted into the upper supply opening nor the cassette inserted into the lower supply opening accommodates the copy sheet for the cover, the size code of the copy sheet in the supply opening currently selected is outputted at step S787 and a multi-hand-supply opening. is set as the supply opening for the copy sheet for the cover at step S789.

The supply opening for the cover is set as described above.

Figure 13:
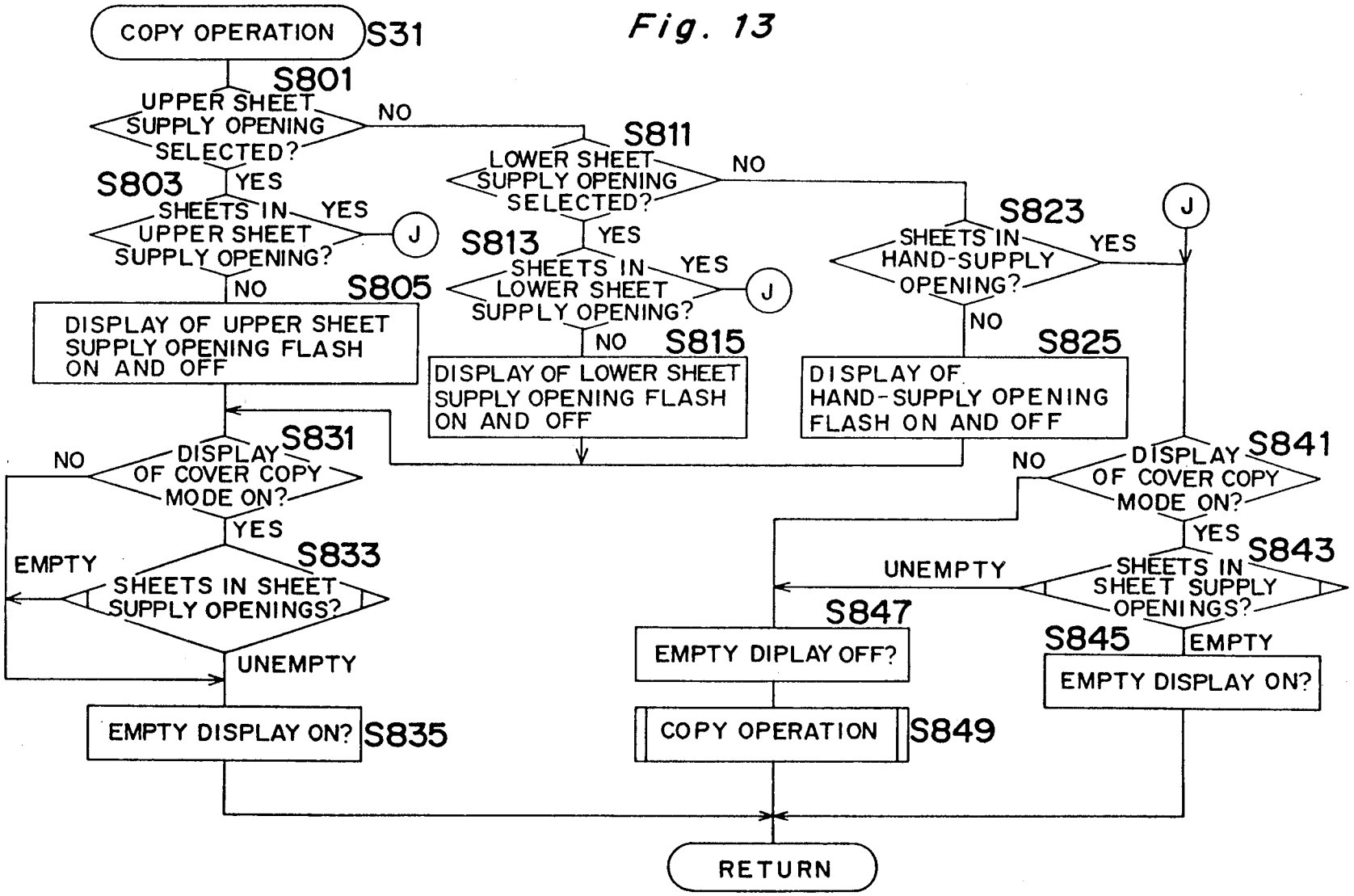

(ix) Processing for copy operation: FIG. 13

In this processing, it is decided whether or not appropriate copy sheets are accommodated in a cassette before processing for executing a copy operation starts at step S849. If no proper copy sheets are accommodated therein, no copying operation is conducted.

For example, if it is decided at step S801 that the upper supply opening is currently selected to supply copy sheets for other than the cover and at step S803 that a cassette inserted into the upper supply opening accommodates no copy sheets, the LED 54*b* flashes on and off for warning at step S805.

Similarly, if it is decided at step S811 that the lower supply opening is currently selected to supply copy sheets for other than the cover and at step S813 that a cassette inserted into the upper supply opening accommodates no copy sheets, the LED 54*c* flashes on and off for warning at step S815.

If it is decided at step S811 that neither the upper supply opening nor the lower supply opening is selected and at step S823 that no copy sheets are placed in the hand-supply section, the LED 54*d* flashes on and off at step S825.

If it is decided at step S831 the cover copy mode is set, it is decided at step S833 whether or not copy sheets for the cover are in a supply opening. If no copy sheets are detected, the LED 54*w* flashes on and off.

After processings are executed at steps S805, S815, 825, S831, and S833, the LED 54*w* flashes on and off at step S835 for warning.

If it is decided at steps S803, S813, S823 that copy sheets are in one of the supply openings, the program goes to step S841 at which it is decided whether or not copy sheets for the cover is accommodated in any cassette as necessary.

That is, if it is decided at step S841 that the cover copy mode is set, it is decided at step S843 whether or not a cassette accommodating a copy sheet for the cover is inserted into any supply opening. If it is decided at step S843 that a cassette accommodating the copy sheet for the cover is not inserted into any supply openings, the LED 54*w* flashes on and off at step S845 for warning.

If it is decided at step S841 that the cover copy mode is not set or if it is decided at step S843 that the cover copy mode is set and the cassette accommodating the copy sheet for the cover is inserted into one of the supply openings, the LED 54*w* is turned off at step S847 and processing for performing a copy operation is executed at step S849.

Figure 14:
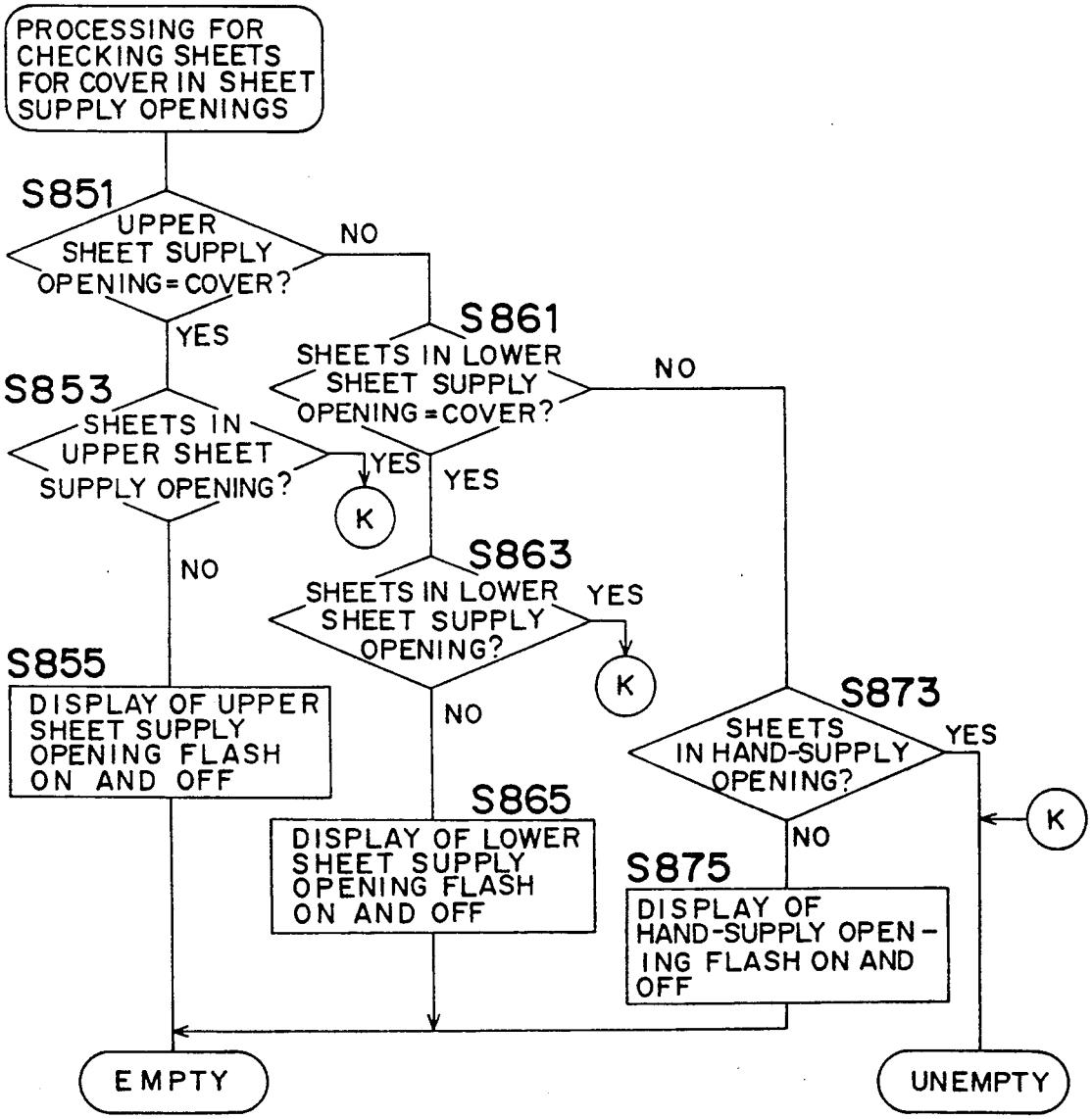

Processing, for checking the existence of the copy sheet for the cover, to be executed at steps S833 and 843 in the cover copy mode is described in detail below with reference to FIG. 14. This processing is executed when the cassettes accommodating the copy sheet for the cover is not inserted into any supply openings.

That is, if it is decided at step S851 that the cassette which is to accommodate the copy sheet for the cover is set in the upper supply opening and if it is decided at step S853 that the cassette does not accommodate the copy sheet currently, the LED 54*b* flashes on and off at step S855.

Similarly, if it is decided at step S861 that the cassette which is to accommodate the copy sheet for the cover is set in the lower supply opening and if it is decided at step S863 that the cassette does not accommodate the copy sheet, the LED 54*c* flashes on and off at step S865.

If it is decided at step S861 that neither the cassette inserted into the upper supply opening nor the lower cassette inserted into the lower supply opening accommodates the copy sheet for the cover and if it is decided at step S873 that the hand-supply section does not have the copy sheet for the cover, the LED 54*d* flashes on and off at step S875.

According to the above embodiment, the ten-key 52 is used as the means for inputting the number of original documents to the CPU 41. In addition, the RDH 10 may be utilized to count the number of original documents before a copying operation is performed. More specifically, in response to a print key operation after cover copy mode is selected, the RDH 10 is operated without operating the main body 20 of the copying apparatus so as to circulate original documents sequentially along a predetermined path. During the circulation of original documents, the sensor 12*s* counts the number of the original documents. Then, a copying operation starts.

Further, both the RDH 10 and the ten-key 52 is used as means for inputting the number of original documents. That is, when the number of original documents are inputted by the ten-key 52 in cover copy mode, a copying operation is started immediately in response to the pressing of the print key 51 without using the RDH 10 so as to perform an operation for counting the number of original documents. When the ten-key 52 is pressed without inputting the number of original documents to the CPU 41, a copying operation is started after the RDH 10 completed the counting operation.

In the above embodiment, when both-side copy mode is selected in cover copy mode, the image of an original document 1, or the cover page is copied on one side of a copy sheet for the cover, the image of an original document 2, or a table page is copied on one side of an ordinary copy sheet, and the image of each of other original documents, or the content pages is copied on both sides of each of ordinary copy sheets. But a modification of the embodiment may be carried out.

For example, in cover copy mode, it is possible for the ten-key 52 to input the number N of original documents and in addition, the number M of pages of table of contents. For example, a series of operations for turning on the key 58 for registering the number of original documents are carried out as follows: the number N of original documents is inputted by the ten-key 52 with the cover copy mode key 55 turned on and the number M of pages of table of contents is inputted by the ten-key 52 with the key 58 for registering the number of original documents turned on. In response to these operations, the CPU 41 recognizes that the numerical value N inputted by the ten-key 52 is the number of original documents and the numerical value M inputted by the ten-key 52 at the second time is the number of cover pages.

For example, let it be supposed that original documents consist of 23 pages including one cover page, two table pages and twenty content pages and that the image of each document having an image on one side thereof is copied on both sides of a copy sheet in cover copy mode. Original documents as shown in Table 5 are set on the tray 11 of the RDH 10. In this condition, a series of input operations for turning on the key 58 for registering the number of original documents are carried out as follows: A numerical value "23" is inputted by the ten-key with the cover copy mode key 55 turned on and a numerical value "2" is inputted by the ten-key 52 with the key 58 for registering the number of original documents turned on. At this time, the image of the original document 1 is copied on one side of a copy sheet for the cover. The image of each of the original documents 2 through 3 (M+1) is copied on one side of each of ordinary copy sheets. The image of each of original documents 4 (M+2) is copied on each of ordinary copy sheets. The detail of image-copied sheets are as shown in Table 6. The image-copied sheet 1 is different from that of other image-copied sheet in quarity.

The number of image-copied sheets is represented as:

$(N-1-M)\div 2+N+2$ when N and M are even.

$(N-1-M)\div 2+N+2$ when N and M are odd.

$(N-2-M)\div 2+N+3$ when N or M is odd.

If the cover has no page number, "0" is inputted as the number of pages of table of contents. The image of the cover is copied on one side of a copy sheet for the cover and the image of each of other pages is copied on both side of each of ordinary copy sheets.

TABLE 5

| | |
|---|---|
| cover | |
| | original document 1 |
| table of contents 1 | |
| | original document 2 |
| table of contents 2 | |
| | original document 3(M + 1) |
| content page 1 | |
| | original document 4(M + 2) |
| content page 2 | |
| | original document 5 |
| . | |
| . | |
| content page 19 | |
| | original document 22 |
| content page 20 | |
| | original document (N) |

TABLE 6

| | |
|---|---|
| cover | |
| | copy sheet 1 |
| table of contents 1 | |
| | copy sheet 2 |
| table of contents 2 | |
| | copy sheet 3 |
| content page 1 | |
| | copy sheet 4 |
| content page 2 | |

TABLE 6-continued

| | |
|---|---|
| content page 3 | |
| | copy sheet 5 |
| content page 4 | |
| . | |
| content page 19 | |
| | copy sheet 13 |
| content page 20 | |

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A copying apparatus comprising:

an original document tray on which a plurality of original documents are piled one on the other in order of page;

original document feeding means for sequentially feeding each original document into a light-exposing section;

image forming means, for forming an image of each original document fed into said light-exposing section on a copy sheet, operable in one-side copy mode in which an image is formed on one side of the copy sheet and both-side copy mode in which two images are formed on both sides thereof, respectively;

copy sheet supply means for accommodating a copy sheet of a first type and a copy sheet of a second type and feeding either the copy sheet of the first type or the second type into said image forming means; and control means for controlling said image forming means and said copy sheet supply means so that the image of a first page of the original documents is formed on one side of a copy sheet of the first type, the image of a second page of the original documents is formed on one side of a copy sheet of the second type, and each image of a third page through the last page of the original documents is formed on both sides of each copy sheet of the second type.

2. A copying apparatus as claimed in claim 1, wherein said original document feeding means feeds original documents set on said original document tray into said light-exposing section in a page-reversed order.

3. A copying apparatus as claimed in claim 2, wherein after said original document feeding means feeds each original document into said light-exposing section and a first light-exposing is performed, each original document exposed is inverted and fed into said light-exposing section again.

4. A copying apparatus as claimed in claim 2, wherein said original document feeding means feeds each original document exposed to light back to said original document tray.

5. A copying apparatus as claimed in claim 4, wherein said original document feeding means counts the number of original documents while said original document feeding means is returning original documents to said original document tray via said exposing section; and said control means controls said image forming means and said copy sheet supply means based on a numerical value counted by said original document feeding means.

6. A copying apparatus as claimed in claim 2, further comprising manual input means for manually inputting a numerical value corresponding to the number of original documents, wherein said control means controls said image forming means and said copy sheet supply means based on the numerical value inputted by manual input means.

7. A copying apparatus comprising:

an original document tray on which N sheets of original documents are piled one on the other in order of page;

original document feeding means for sequentially feeding each original document into a light-exposing section in a page-reversed order;

image forming means, for forming an image of each original document fed into said light-exposing section on a copy sheet, operable in one-side copy mode in which an image is formed on one side of the copy sheet and both-side copy mode in which two images are formed on both sides thereof, respectively;

copy mode selecting means for selecting either said one-side copy mode or both-side copy mode, means for inputting the number N of original documents;

first copy sheet supply means for feeding a plurality of copy sheets into said image forming means one by one;

second copy sheet supply means for feeding a plurality of copy sheets different in type from those fed by said first copy sheet supply means into said image forming means one by one;

cover copy mode selecting means for selecting cover copy mode; and control means for controlling said image forming means, said first copy sheet supply means, and said second copy sheet supply means so that when both-side copy mode and cover copy mode are selected, each image of a third page through the last page of the original documents is formed on both sides of each copy sheet supplied from said first copy sheet supply means, the image of a second page of the original documents is formed on one side of a copy sheet supplied from said first copy sheet supply means, and the image of a first page of the original documents is formed on one side of a copy sheet supplied from said second copy sheet supply means.

8. A copying apparatus as claimed in claim 7, wherein means for inputting the number of original documents consists of a numerical value input key.

9. A copying apparatus as claimed in claim 7, wherein means for inputting the number of original documents operates said original document feeding means and detects the number of original documents while original documents are being fed.

10. A copying apparatus as claimed in claim 7, wherein said original document feeding means is capable of feeding the first and second sides of each original document into said light-exposing section.

11. A copying apparatus comprising:

an original document tray on which a plurality of original documents are piled one on the other in order of page;

original document feeding means for sequentially feeding each original document into a light-exposing section;

image forming means, for forming an image of each original document fed into said light-exposing section on a copy sheet, operable in one-side copy mode in which an image is formed on one side of the copy sheet and both-side copy mode in which two images are formed on both sides thereof, respectively;

numerical value input means for inputting a natural number M ($0<M$);

copy sheet supply means accommodating copy sheets of first and second types and selectively feeding either copy sheets of the first type or copy sheets of the second type into said image forming means; and control means for controlling said image forming means and said copy sheet supply means so that the image of a first page of the original documents is formed on one side of a copy sheet of the first type, each image of a second page through $(M+1)$th page of the original documents is formed on one side of each copy sheet of the second type, and each images of $(M+2)$th page through the last page of the original documents is formed on both sides of each copy sheet of the second type.

12. A copying apparatus as claimed in claim 11, wherein said original document feeding means feeds original documents set on said original document tray into said light-exposing section in a page-reversed order.

13. A copying apparatus as claimed in claim 12, wherein after said original document feeding means feeds each original document into said light-exposing section and a first light-exposing is performed, each original document exposed is inverted and fed into said light-exposing section again when each original document has images on both sides thereof.

14. A copying apparatus as claimed in claim 12, wherein said original document feeding means feeds each original document exposed to light back to said original document tray.

15. A copying apparatus as claimed in claim 14, wherein said original document feeding means counts the number of original documents while said original document feeding means is returning original documents to said original document tray via said exposing section; and said control means controls said image forming means and said copy sheet supply means based on a numerical value counted by said original document feeding means.

16. A copying apparatus as claimed in claim 12, wherein said numerical value input means is capable of inputting the number N of original documents; and said control means controls said image forming means and said copy sheet supply means based on inputted numerical values M and N.

17. A copying apparatus comprising:

an original document tray on which a plurality of original documents are piled one on the other in order of page;

original document feeding means for sequentially feeding each original document into a light-exposing section;

image forming means, for forming an image of each original document fed into said light-exposing section on a copy sheet, operable in one-side copy mode in which an image is formed on one side of the copy sheet and both-side copy mode in which two images are formed on both sides thereof, respectively;

copy sheet supply means for feeding a plurality of copy sheets into said image forming means one by one; and control means for controlling said image forming means so that each image of a third page through the last page of the original documents is formed on both sides of each copy sheet supplied from said copy sheet supply means; and each image of a first page and a second page of the original documents is formed on one side of each copy sheet supplied from said copy sheet supply means.

18. A copying apparatus as claimed in claim 17, wherein said original document feeding means feeds original documents set on said original document tray into said light-exposing section in a page-reversed order.

19. A copying apparatus as claimed in claim 18, wherein after said original document feeding means feeds each original document into said light-exposing section and a first light-exposing is performed, each original document exposed is inverted and fed into said light-exposing section again.

20. A copying apparatus as claimed in claim 18, wherein said original document feeding means feeds each original document exposed to light back to said original document tray.

21. A copying apparatus as claimed in claim 20, wherein said original document feeding means counts the number of original documents while said original document feeding means is returning original documents to said original document tray via said exposing section; and said control means controls said image forming means and said copy sheet supply means based on a numerical value counted by said original document feeding means.

22. A copying apparatus as claimed in claim 18, further comprising manual input means for manually inputting the number of original documents, wherein said control means controls said image forming means and said copy sheet supply means based on a numerical value inputted by manual input means.

* * * * *